US009377742B2

(12) United States Patent
Takamizawa et al.

(10) Patent No.: US 9,377,742 B2
(45) Date of Patent: Jun. 28, 2016

(54) PRINT CONTROL APPARATUS, AND METHOD, FOR SELECTING A CONTROL MODE FOR USE IN PRINTING IMAGE DATA

(71) Applicants: Takuma Takamizawa, Kanagawa (JP); Hiroaki Suzuki, Chiba (JP)

(72) Inventors: Takuma Takamizawa, Kanagawa (JP); Hiroaki Suzuki, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/547,321

(22) Filed: Nov. 19, 2014

(65) Prior Publication Data

US 2015/0138575 A1 May 21, 2015

(30) Foreign Application Priority Data

Nov. 20, 2013 (JP) ..... 2013-239942

(51) Int. Cl.
*G06G 1/00* (2006.01)
*G03G 15/00* (2006.01)

(52) U.S. Cl.
CPC .... *G03G 15/6585* (2013.01); *G03G 2215/0081* (2013.01)

(58) Field of Classification Search
None
See application file for complete search history.

(56) References Cited

U.S. PATENT DOCUMENTS 8,412,086 B2 * 4/2013 Matsudaira ..... G03G 15/2014 156/277
8,947,732 B2 * 2/2015 Kurosawa et al. ..... 358/1.9
2011/0058200 A1 * 3/2011 Miyahara ..... H04N 1/603 358/1.9
2012/0062956 A1 3/2012 Kitagawa et al.
2012/0063802 A1 * 3/2012 Suzuki ..... G03G 15/6585 399/82
2013/0070268 A1 3/2013 Yoshida et al.
2013/0242350 A1 9/2013 Yoshida et al.
2013/0271791 A1 * 10/2013 Miyazaki et al. ..... 358/2.1
2013/0271792 A1 * 10/2013 Awamura et al. ..... 358/3.01
2013/0278953 A1 * 10/2013 Yukie et al. ..... 358/1.9

FOREIGN PATENT DOCUMENTS

JP 2003-162199 6/2003
JP 2012-083736 4/2012

* cited by examiner

*Primary Examiner* — Steven Kau
(74) *Attorney, Agent, or Firm* — Oblon, McClelland, Maier & Neustadt, L.L.P.

(57) ABSTRACT

A print control apparatus includes a receiving unit which receives print data containing gloss-control-plane image data indicating gloss control values for identifying a type of surface effect and a region where the surface effect is to be applied, a storage unit which stores information containing multiple total-amount control modes and stores surface-effect choice information which defines, for each of the gloss control values, the surface effect type, a total-amount control mode, and a priority level of the total-amount control mode, a generating unit which generates transparent-developing-material image data indicating pixel-by-pixel density values each depending on a transparent-developing-material recording amount, and a selecting unit which selects a total-amount control mode whose priority level is highest in total-amount control modes of surface effect types associated with the gloss control values of the gloss-control-plane image data as a total-amount control mode for use in printing the transparent-developing-material image data.

13 Claims, 20 Drawing Sheets

FIG.1
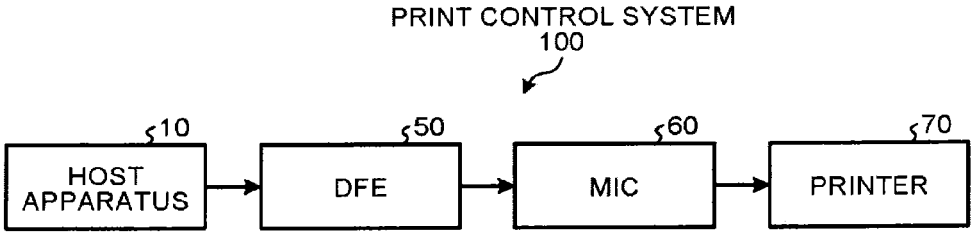
FIG.2
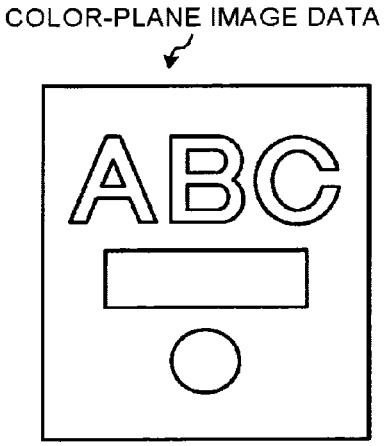
FIG.3
| NAME OF GLOSS CONTROL | GLOSS | DEVIATION |
|---|---|---|
| PREMIUM GLOSS (PG) | Gs ≥ 80 | Δ Gs ≤ 10 |
| GLOSS (G) | Gs = Gs (OF NORMAL GLOSS) | Δ Gs ≤ 10 |
| MATTE (M) | Gs = Gs (OF 30% DOT PATTERN OF 1C) | Δ Gs ≤ 10 |

| USER-SPECIFIED SURFACE EFFECT TYPE | DENSITY VALUE OF GLOSS CONTROL PLANE [%] |
|---|---|
| PG | 98% |
| G | 90% |
| M | 16% |

| DRAWING OBJECT | COORDINATES | DENSITY VALUE |
|---|---|---|
| A, B, C | (x1,y1)-(x2,y2) | 98% |
| (RECTANGLE) | (x3,y3)-(x4,y4) | 90% |
| ... | ... | ... |

FIG.15

| DENSITY (%) | DENSITY VALUE | | | EFFECT | GLOSSER | PRINTER | LOW-TEMP FIXING MACHINE | TOTAL-AMOUNT CONTROL MODE | PRIORITY LEVEL |
|---|---|---|---|---|---|---|---|---|---|
| | REPRESENTATIVE VALUE | NUMERICAL RANGE | | | | | | | |
| 98% | 250 | 248 | 255 | PG: TYPE A | ON | INVERSE MASK A | NO DATA | A | 1ST |
| 96% | 245 | 243 | 247 | PG: TYPE B | ON | INVERSE MASK B | NO DATA | A | |
| 94% | 240 | 238 | 242 | PG: TYPE C | ON | INVERSE MASK C | NO DATA | A | |
| 92% | 235 | 233 | 237 | RESERVED | | | | | |
| 90% | 230 | 228 | 232 | G: TYPE 1 | OFF | INVERSE MASK 1 | NO DATA | A | 3RD |
| 88% | 224 | 222 | 227 | G: TYPE 2 | OFF | INVERSE MASK 2 | NO DATA | A | |
| 86% | 219 | 217 | 221 | G: TYPE 3 | OFF | INVERSE MASK 3 | NO DATA | A | |
| 84% | 214 | 212 | 216 | G: TYPE 4 | OFF | INVERSE MASK 4 | NO DATA | A | |
| 82% | 209 | 207 | 211 | RESERVED | | | | | |
| 46% | 117 | 115 | 119 | RESERVED | | | | | |
| 44% | 112 | 110 | 114 | WATERMARK TEXT 3 (XXX) | OFF | NO DATA | TILE: TEXT STRING 3 | B | 5TH |
| 42% | 107 | 105 | 109 | WATERMARK TEXT 2 (COPYING IS STRICTLY PROHIBITED) | | NO DATA | TILE: TEXT STRING 2 | B | |
| 40% | 102 | 100 | 104 | WATERMARK TEXT 1 (SAMPLE) | | NO DATA | TILE: TEXT STRING 1 | B | |
| 38% | 97 | 95 | 99 | RESERVED | | | | | |
| 36% | 92 | 90 | 94 | RESERVED | | | | | |
| 34% | 87 | 85 | 89 | BACKGROUND PATTERN 3 (XXX) | | NO DATA | TILE: BACKGROUND PATTERN 3 | B | |
| 32% | 82 | 80 | 84 | BACKGROUND PATTERN 2 (GRID) | | NO DATA | TILE: BACKGROUND PATTERN 2 | B | |
| 30% | 76 | 74 | 79 | BACKGROUND PATTERN 1 (WAVE) | | NO DATA | TILE: BACKGROUND PATTERN 1 | B | |
| 28% | 71 | 69 | 73 | RESERVED | | | | | |
| 26% | 66 | 64 | 68 | RESERVED | | | | | |
| 24% | 61 | 59 | 63 | TACTILE PATTERN: TYPE 3 (ROUGH) | | NO DATA | TILE: NETWORK PATTERN 3 | B | |
| 22% | 56 | 54 | 58 | TACTILE PATTERN: TYPE 2 (MEDIUM) | | NO DATA | TILE: NETWORK PATTERN 2 | B | |
| 20% | 51 | 49 | 53 | TACTILE PATTERN: TYPE 1 (FINE) | | NO DATA | TILE: NETWORK PATTERN 1 | B | |
| 18% | 46 | 44 | 48 | RESERVED | | | | | |
| 16% | 41 | 39 | 43 | DOT PATTERN MATTE: TYPE 4 | OFF | HALFTONE 4 | NO DATA | C | 4TH |
| 14% | 36 | 34 | 38 | DOT PATTERN MATTE: TYPE 3 | OFF | HALFTONE 3 | NO DATA | C | |
| 12% | 31 | 29 | 33 | DOT PATTERN MATTE: TYPE 2 | OFF | HALFTONE 2 | NO DATA | C | |
| 10% | 25 | 23 | 28 | DOT PATTERN MATTE: TYPE 1 | OFF | HALFTONE 1 | NO DATA | C | |
| 8% | 20 | 18 | 22 | RESERVED | | | | | |
| 6% | 15 | 13 | 17 | FROSTED: TYPE C | ON&OFF | NO DATA | SOLID | C | 2ND |
| 4% | 10 | 8 | 12 | FROSTED: TYPE B | ON&OFF | NO DATA | SOLID | C | |
| 2% | 5 | 1 | 7 | FROSTED: TYPE A | ON&OFF | NO DATA | SOLID | C | |
| 0% | 0 | 0 | 0 | NONE | OFF | NO DATA | NO DATA | | |

FIG.16
| TOTAL-AMOUNT CONTROL MODE | TOTAL-AMOUNT LIMIT VALUE | ENGINE SPEED |
|---|---|---|
| A | HIGH | LOW |
| B | MEDIUM | MEDIUM |
| C | LOW | HIGH |
FIG.17
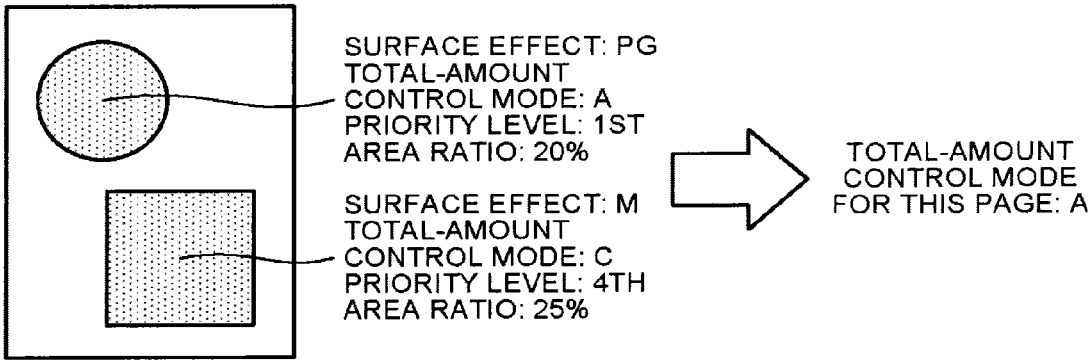
FIG.18
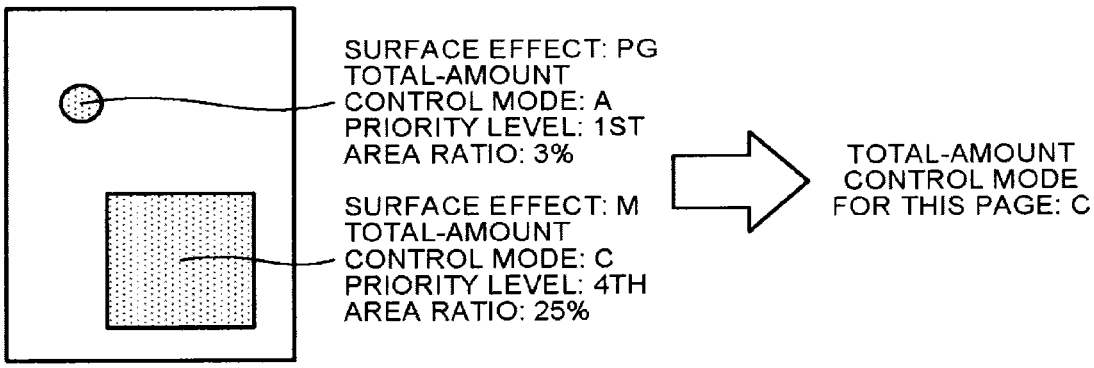

PRINT CONTROL APPARATUS, AND METHOD, FOR SELECTING A CONTROL MODE FOR USE IN PRINTING IMAGE DATA

CROSS-REFERENCE TO RELATED APPLICATIONS

The present application claims priority to and incorporates by reference the entire contents of Japanese Patent Application No. 2013-239942 filed in Japan on Nov. 20, 2013.

BACKGROUND OF THE INVENTION

1. Field of the Invention

The present invention relate generally to a print control apparatus, a print control method, and a non-transitory computer-readable medium.

2. Description of the Related Art

Some type of known image processing apparatus includes a clear toner which is colorless toner containing no colorant in addition to color toners of four colors of cyan (C), magenta (M), yellow (Y), and black (K), for example. Visual and/or tactile effect (hereinafter, "surface effect") can be produced by fixing a toner image formed with a clear toner onto transfer paper where an image is formed with the CMYK toners. The produced surface effect varies depending on what toner image is formed with the clear toner and how the clear-toner image is fixed. Some type of surface effect may simply give a gloss, while some surface effect may reduce gloss. Some type of surface effect is applied for surface protection. Some type of surface effect may be applied only to a part of a surface rather than to the entire surface. Some type of surface effect may be applied to add a texture or a watermark with clear toner. Surface effect can be produced not only by way of controlling fixing but also by causing a dedicated postprocessing device, such as a glosser or a low-temperature fixing device, to apply finishing. A technique for controlling deposition of clear toner using a gloss control plane is provided in recent years. An example of the technique is disclosed in Japanese Laid-open Patent Application No. 2012-083736.

Meanwhile, there is a limit on a total amount of developing material, such as ink or toner, which can be recorded (deposited) by an image processing apparatus on a recording member. There can be a case where an image is formed with toners of five or more colors consisting of the CMYK four colors and a special toner(s). In such a case, if a total amount of the toners is excessively large, a resultant printed image is typically undesirably degraded in image quality due to text "bleed" caused by scattered toner or unevenly fixed toner. There is a known scheme for limiting the total amount of developing materials to prevent the total amount from exceeding the limit. Hereinafter, this technique is referred to as "total amount control".

Known examples of such a scheme include a total-amount control scheme (which is a combination of a specific total-amount limit value and an engine speed), which achieves high image quality by increasing an upper limit of total toner amount (total-amount limit value) by making use of fact that the lower engine speed, the larger the amount of toner which can be fixed to paper. Another known total-amount control scheme maintains productivity by reducing the total-toner-amount limit value rather than reducing the engine speed.

A printer disclosed in Japanese Laid-open Patent Application No. 2003-162199 is configured to switch an engine speed depending on an amount of toners to be used in printing print data to provide a certain level of print quality and achieve effective printing.

However, because such a conventional total amount control scheme does not take influence of total amount control on surface effect into account, total amount control can be a cause of failure in producing desired surface effect in some cases.

Therefore, it is desirable to provide a print control apparatus, a print control method, and a non-transitory computer-readable medium capable of switching to an appropriate total-amount control mode while taking influence of total amount control on surface effect into account.

SUMMARY OF THE INVENTION

It is an object of the present invention to at least partially solve the problems in the conventional technology.

According to an aspect of the present invention, there is provided a print control apparatus including: a receiving unit configured to receive print data containing gloss-control-plane image data indicating gloss control values, each of the gloss control values being for identifying a type of surface effect to be applied using a transparent developing material to a region on a recording member where an image is to be recorded and the region where the surface effect is to be applied on the recording member; a storage unit configured to store total-amount-control mode information containing multiple total-amount control modes, each of the total-amount control modes being a combination of a total-amount limit value indicating an upper limit of a developing-material recording amount and a printing speed, and store surface-effect choice information defining, for each of the gloss control values, the surface effect type, a total-amount control mode, and a priority level of application of the total-amount control mode; a generating unit configured to generate transparent-developing-material image data from the gloss-control-plane image data and the surface-effect choice information, the transparent-developing-material image data indicating pixel-by-pixel density values of the image, each of the density values depending on a recording amount of the transparent developing material; and a selecting unit configured to select, based on the gloss-control-plane image data and the surface-effect choice information, a total-amount control mode of which priority level is highest in total-amount control modes of surface effect types associated with the gloss control values contained in the gloss-control-plane image data as a total-amount control mode for use in printing the transparent-developing-material image data.

According to another aspect of the present invention, there is provided a print control method performed by a print control apparatus, the print control method including: receiving print data containing gloss-control-plane image data indicating gloss control values, each of the gloss control values being for identifying a type of surface effect to be applied using a transparent developing material to a region on a recording member where an image is to be recorded and the region where the surface effect is to be applied on the recording member; referring total-amount-control mode information containing multiple total-amount control modes, each of the total-amount control modes being a combination of a total-amount limit value indicating an upper limit of a developing-material recording amount and a printing speed, and storing surface-effect choice information defining, for each of the gloss control values, the surface effect type, a total-amount control mode, and a priority level of application of the total-amount control mode; generating transparent-developing-material image data from the gloss-control-plane image data and the surface-effect choice information, the transparent-developing-material image data indicating pixel-by-pixel density values of the image, each of the density values depending on a recording amount of the transparent developing material; and selecting a total-amount control mode of which priority level is highest in total-amount control modes of surface effect types associated with the gloss control values contained in the gloss-control-plane image data as a total-amount control mode for use in printing the transparent-developing-material image data based on the gloss-control-plane image data and the surface-effect choice information.

According to still another aspect of the present invention, there is provided a non-transitory computer-readable medium including computer readable program codes, performed by a computer, the program codes when executed causing the computer to execute: receiving print data containing gloss-control-plane image data indicating gloss control values, each of the gloss control values being for identifying a type of surface effect to be applied using a transparent developing material to a region on a recording member where an image is to be recorded and the region where the surface effect is to be applied on the recording member; referring total-amount-control mode information containing multiple total-amount control modes, each of the total-amount control modes being a combination of a total-amount limit value indicating an upper limit of a developing-material recording amount and a printing speed, and storing surface-effect choice information defining, for each of the gloss control values, the surface effect type, a total-amount control mode, and a priority level of application of the total-amount control mode; generating transparent-developing-material image data from the gloss-control-plane image data and the surface-effect choice information, the transparent-developing-material image data indicating pixel-by-pixel density values of the image, each of the density values depending on a recording amount of the transparent developing material; and selecting a total-amount control mode of which priority level is highest in total-amount control modes of surface effect types associated with the gloss control values contained in the gloss-control-plane image data as a total-amount control mode for use in printing the transparent-developing-material image data based on the gloss-control-plane image data and the surface-effect choice information. The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1 is a diagram illustrating an example configuration of a print control system of a first embodiment;

FIG. 2 is a diagram illustrating an example of color-plane image data of the first embodiment;

FIG. 3 is a diagram illustrating an example of surface effect types related to absence/presence of gloss of the first embodiment;

FIG. 15 is a diagram illustrating an example of surface-effect choice information of the first embodiment;

FIG. 16 is a diagram illustrating an example of total-amount-control mode information of the first embodiment;

FIG. 17 is a diagram illustrating an example of selecting a total-amount control mode of the first embodiment;

FIG. 18 is a diagram illustrating another example of selecting a total-amount control mode of the first embodiment;

DETAILED DESCRIPTION OF THE PREFERRED EMBODIMENTS

Figure 4:
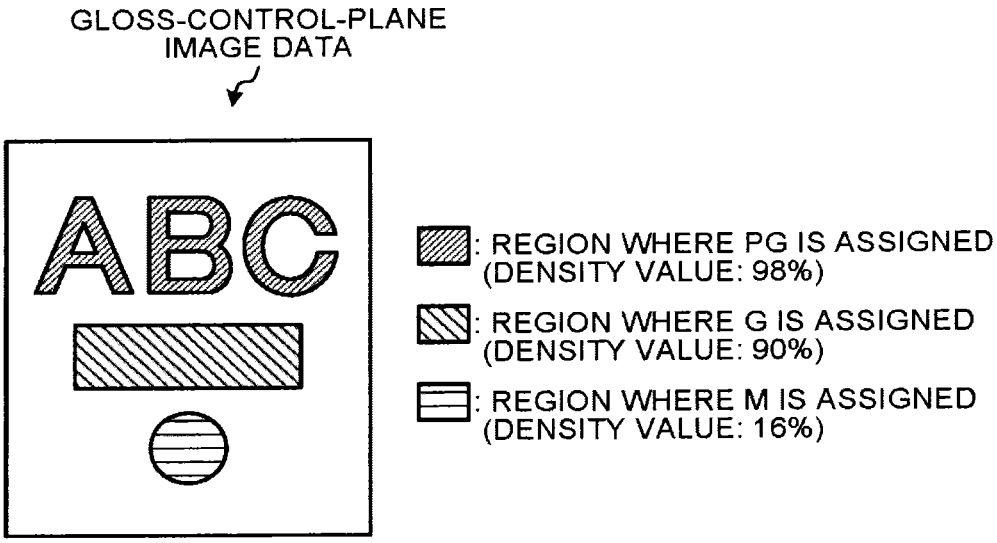
FIG. 4 is a diagram illustrating an example of gloss-control-plane image data of the first embodiment.

Exemplary embodiments of the present invention are described in detail below with reference to the accompanying drawings.

First Embodiment

A print control system 100 of a first embodiment is described below. The first embodiment is described on an assumption that color toners and a clear toner are used as color developing materials and a transparent developing material, respectively. However, the developing materials are not limited to such toners and may be any developing materials. For example, ink may be used as the developing materials.

A configuration of the print control system 100 according to the first embodiment is described below. FIG. 1 is a diagram illustrating an example configuration of the print control system 100 of the first embodiment. The print control system 100 of the first embodiment includes a host apparatus 10, a print control apparatus (digital front end) 50 (hereinafter, "the DFE 50"), an interface controller (mechanism interface controller) 60 (hereinafter, "the MIC 60"), and a printer 70.

The host apparatus 10 is connected to the DFE 50. The host apparatus 10 and the DFE 50 may be connected to each other via a wired or wireless network. The host apparatus 10 generates print data (document data representing an original document) which is described in a language such as PDL (page description language) using pre-installed application software. The host apparatus 10 transmits the print data to the DFE 50. The host apparatus 10 may be embodied as, for example, a PC (personal computer). The host apparatus 10 will be described in detail later with reference to FIG. 6.

The DFE 50 communicates with the printer 70 via the MIC 60. The DFE 50 receives the print data from the host apparatus 10. The DFE 50 converts the print data described in a language such as PDL into color-toner image data and clear-toner image data rendered in a format printable by the printer 70. The color-toner image data indicates a recording amount of color toners with pixel-by-pixel density values on a target image. The clear-toner image data indicates a recording amount of the clear toner with density values on a per-pixel basis of the image. The DFE 50 transmits the color-toner image data and the clear-toner image data to the printer 70 via the MIC 60. The DFE 50 controls image formation by the printer 70 in this manner. The DFE 50 will be described in detail later with reference to FIG. 14.

The printer 70 receives the color-toner image data and the clear-toner image data from the DFE 50 via the MIC 60. The printer 70 includes a cartridge, image forming units, an exposure device, and a fixing device. Each of the image forming units includes a photoconductor, a charging device, a developing device, and a photoconductor cleaner. The cartridge houses the toners (the color toners and the clear toner). In the first embodiment, the color toners are toners of the CMYK colors. The clear toner is a transparent (colorless) toner containing no colorant. Meanwhile, the term "transparent (colorless)" is used to indicate having light transmittance of 70% or higher, for example.

The printer 70 forms an image represented by the color-toner image data and the clear-toner image data on a recording medium such as transfer paper. More specifically, the printer 70 causes the charging devices to charge the photoconductors and causes the exposure devices to irradiate the photoconductors with light beams, thereby forming toner images on the photoconductors. The printer 70 transfers the toner images formed on the photoconductors onto the recoding medium while overlaying the toner images on one another and causes the fixing device to apply heat and pressure to the recoding medium at a temperature (normal temperature) within a predetermined range, thereby fixing the toner images onto the recoding medium. The printer 70 forms the image on the recording medium in this manner. The structure of such a printer as the printer 70 described above is widely known, and detailed description is omitted.

The print data (document data), which is transmitted from the host apparatus 10 and received by the DFE 50, is described below. The host apparatus 10 generates print data using the pre-installed image processing application program (an image processing unit 212, a plane-data generating unit 214, a print-data generating unit 215, and the like, which will be described later) and transmits the print data to the DFE 50. The image processing application program (hereinafter, "image processing application") is capable of handling not only image data which defines per-color density values (hereinafter, "density values") of each of color planes, which can be RGB (red, green, and blue) planes or CMYK planes, for example, on a per-pixel basis, but also image data of a special color plane. The special-color-plane image data is image data for use in depositing a special toner or ink of, for example, white, gold, and/or silver in addition to basic colors such as CMYK or RGB. The special-color-plane image data is data for a printer including such a special toner or ink. Meanwhile, there can be a case where R is added as a special color to the CMYK basic colors or a case where Y is added as a special color to the RGB basic colors to enhance color reproducibility. Conventionally, the clear toner is handled as one of special colors.

The print control system 100 of the first embodiment uses the clear toner, which is a special color, in applying surface effect, which is a visual or tactile effect, to transfer paper and in forming a transparent image such as a watermark or a texture other than the surface effect.

Accordingly, the image processing application of the host apparatus 10 generates, from image data fed to the host apparatus 10, not only color-plane image data but also special-color-plane image data (which is at least one of gloss-control-plane image data and clear-plane image data) in accordance with user's specification. The host apparatus 10 transmits print data containing the color-plane image data and further containing, as required, the special-color-plane image data to the DFE 50.

The color-plane image data, the gloss-control-plane image data, and the clear-plane image data are described below.

FIG. 2 is a diagram illustrating an example of color-plane image data of the first embodiment. The color-plane image data is image data which defines per-color density values of the RGB colors, the CMYK colors, or the like on a per-pixel basis. An image represented by the color-plane image data is formed using the color toners. The color-plane image data indicates color density values with 8 bits for each of color components in accordance with colors specified by a user. For example, color density values of a single pixel can be represented using RGB values as follows: R is represented by 8 bits; G is represented by 8 bits; B is represented by 8 bits. In the example illustrated in FIG. 8, density values for colors specified by a user using the image processing application are assigned to each of drawing objects such as "A", "B", and "C".

The gloss-control-plane image data indicates gloss control values for identifying a type of surface effect to be applied to a region on a recording member where an image is to be formed using the clear toner and the region where the surface effect is to be applied. The gloss-control-plane image data thus allows identifying the type of the surface effect, which is a visual or tactile effect to be applied to the region on the recording member such as transfer paper. The image represented by the gloss-control-plane image data is formed using the clear toner.

As does the color-plane image data which represents an image with RGB values or CMYK values, for example, the gloss-control-plane image data represents an image with 8-bit density values in a range from "0" to "255" on a pixel-by-pixel basis. Note that the density values (the density values may alternatively be 16-bit values or 32-bit values, or expressed as 0 to 100%) in the gloss-control-plane image data are respectively associated with surface effect types.

A same value is assigned to an area(s) where same surface effect is to be applied independently of density of the clear toner that is actually applied. Accordingly, even without data indicating regions, regions are easily identifiable based on the image data as required. Put another way, the gloss-control-plane image data indicates surface effect types and regions where surface effect is to be applied. (Separate data indicating the regions may be added.)

The host apparatus 10 generates the gloss-control-plane image data (gloss-control-plane data) in a vector format as follows. The host apparatus 10 expresses the surface effect types specified on the per-drawing-object basis by the user using the image processing application in density values each representing corresponding surface effect such as gloss.

Pixels belonging to the gloss-control-plane image data are respectively associated with the pixels of the color-plane image data. The per-pixel density values of the gloss-control-plane image data and the color-plane image data serves as pixel values. Each of the color-plane image data and the gloss-control-plane image data is configured as per-page data.

Surface effect can be roughly classified into types including types related to absence/presence of gloss, surface protection, information-embedded watermark, and texture. The surface effect types related to absence/presence of gloss are described below.

FIG. 3 is a diagram illustrating an example of surface effect types related to absence/presence of gloss of the first embodiment. Referring to the example illustrated in FIG. 3, there are three surface effect types related to absence/presence of gloss. The types are mirror-like gloss (hereinafter, "premium gloss"), normal gloss, and dot pattern matte (hereinafter, "matte") in an ascending order of gloss levels (glossiness). Hereinafter, the mirror-like gloss may be referred to as "PG"; the gloss may be referred to as "G"; the matte may be referred to as "M".

Each of the premium gloss and the gloss enhances gloss by high degree, while the matte reduces gloss. Referring to FIG. 3, the premium gloss has Gs (glossiness) of 80 or higher; the gloss has normal glossiness of a primary color or a secondary color; the matte has glossiness of 30% dot pattern of a primary color. Variation of glossiness, which is denoted by $\Delta Gs$, is set to be 10 or lower. Density values are associated with surface effect types in such a manner that the higher the surface effect enhances gloss, the higher the density value associated with the surface effect, while the lower the surface effect reduces gloss, the lower the density value associated with the surface effect. Density values in-between such a high density value and such a low density values are assigned to surface effect types such as watermark and texture.

Examples of the watermark include texts and background patterns. The texture represents a text or a pattern and can give not only a visual effect but also a tactile effect. Examples of the texture include stained glass patterns. The surface protection is provided by applying the premium gloss or the gloss. Regions to which surface effect is to be applied in an image and types of the surface effect to be applied are specified by a user using the image processing application. The host apparatus 10 which executes the image processing application generates gloss-control-plane image data by assigning density values, each of which depends on a user-specified surface effect, to drawing objects belonging to the user-specified regions on a per-drawing-object basis. Relationship between density values and surface effect types will be described later.

FIG. 4 is a diagram illustrating an example of the gloss-control-plane image data of the first embodiment. In the example gloss control plane illustrated in FIG. 4, a user assigns the surface effect "PG (premium gloss)" to a drawing object "ABC". The surface effect "G (gloss)" is assigned to a drawing object "rectangle". The surface effect "M (matte)" is assigned to a drawing object "circle". The density values assigned to the surface effect types are determined by looking up density-value choice information (see FIG. 9), which will be described later, for the surface effect types.

Figure 5:
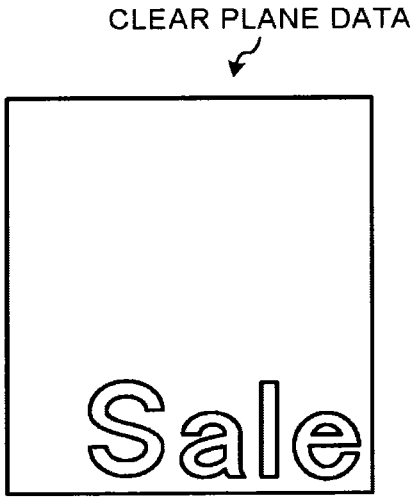
FIG. 5 is an explanatory diagram illustrating an example of clear-plane image data of the first embodiment.

FIG. 5 is an explanatory diagram illustrating an example of the clear-plane image data of the first embodiment. The clear-plane image data is image data representing a transparent image, such as a watermark or a texture, other than the surface effect described above. The image represented by the clear-plane image data is formed using the clear toner. The example clear-plane image data illustrated in FIG. 5 represents a watermark "Sale".

The host apparatus 10 generates special-color-plane image data (gloss-control-plane image data and clear-plane image data) in a plane other than the planes of the color-plane image data using the image processing application. The host apparatus 10 describes the color-plane image data, and the gloss-control-plane image data and the clear-plane image data (hereinafter, "image data of the respective planes") in a portable document format (PDF) and generates document data by combining the PDF image data of the respective planes. The data format of the image data of respective planes is not limited to PDF but may be any desired format.

Figure 6:
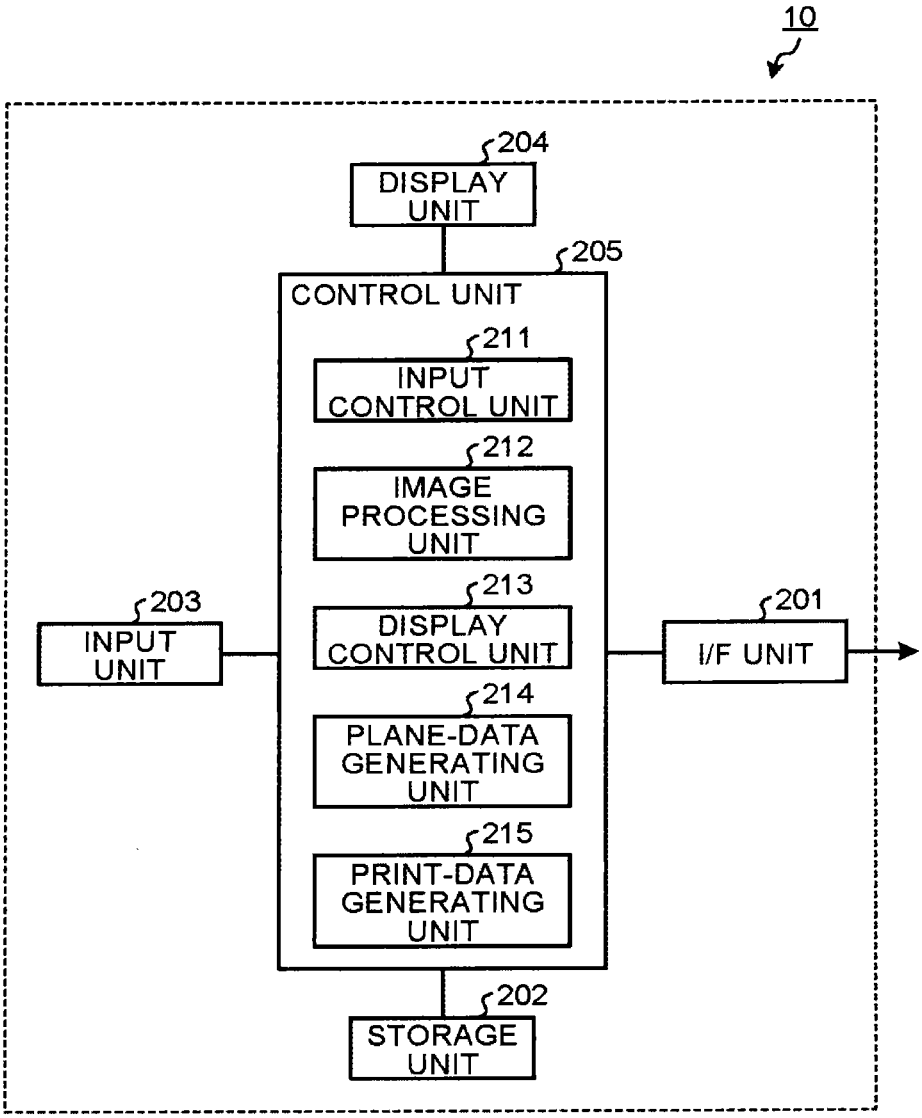
FIG. 6 is a block diagram illustrating an example configuration of a host apparatus of the first embodiment.

The host apparatus 10 is described in detail below. FIG. 6 is a block diagram illustrating an example configuration of the host apparatus 10 of the first embodiment. The host apparatus 10 includes an I/F unit 201, a storage unit 202, an input unit 203, a display unit 204, and a control unit 205.

The I/F unit 201 is an interface device for communication with the DFE 50. The storage unit 202 is a storage medium such as a hard disk drive (HDD) or a memory which stores various types of data. The input unit 203 is an input device for use by a user to perform various input operations. The input unit 203 may be embodied as a keyboard and a mouse, for example. The display unit 204 is a display device for displaying various screens. The display unit 204 may be embodied as a liquid crystal panel, for example.

The control unit 205 is a computer made up of a CPU (central processing unit), a ROM (read only memory), a RAM (random access memory), and the like. The control unit 205 provides overall control of the host apparatus 10. The control unit 205 includes an input control unit 211, the image processing unit 212, a display control unit 213, the plane-data generating unit 214, and the print-data generating unit 215. The input control unit 211 and the display control unit 213 are implemented by the CPU by reading out an operating system program stored in the ROM or the like and executing the program. The image processing unit 212, the plane-data generating unit 214, and the print-data generating unit 215 are implemented by the CPU by reading out the image processing application program described above stored in the ROM or the like and executing the program. The plane-data generating unit 214 may be provided as a plugin feature installed in the image processing application, for example. Some part or all of each of the units may be implemented in independent circuit (hardware).

The input control unit 211 receives input information responsive to user's input accepted by the input unit 203. For example, a user may input image specification information which specifies an image, to which surface effect is to be applied, from among images stored in the storage unit 202 by operating the input unit 203. (Examples of the image include a photograph, a text, a figure, or a composite image of two or more of them). The image specification information may be provided by a method other than the method of accepting user's input via the input unit 203.

The display control unit 213 controls the display unit 204 so as to display various types of information. For instance, when image specification information is accepted by the input control unit 211, the display control unit 213 reads out an image specified by the image specification information from the storage unit 202 and controls the display unit 204 so as to display the read-out image on a screen.

A user inputs surface-effect specification information which specifies a region, to which surface effect is to be applied, and a type of the surface effect by operating the input unit 203 while viewing the image displayed on the display unit 204. The surface-effect specification information may be fed by a method other than the method of accepting user's specification via the input unit 203.

Figure 7:
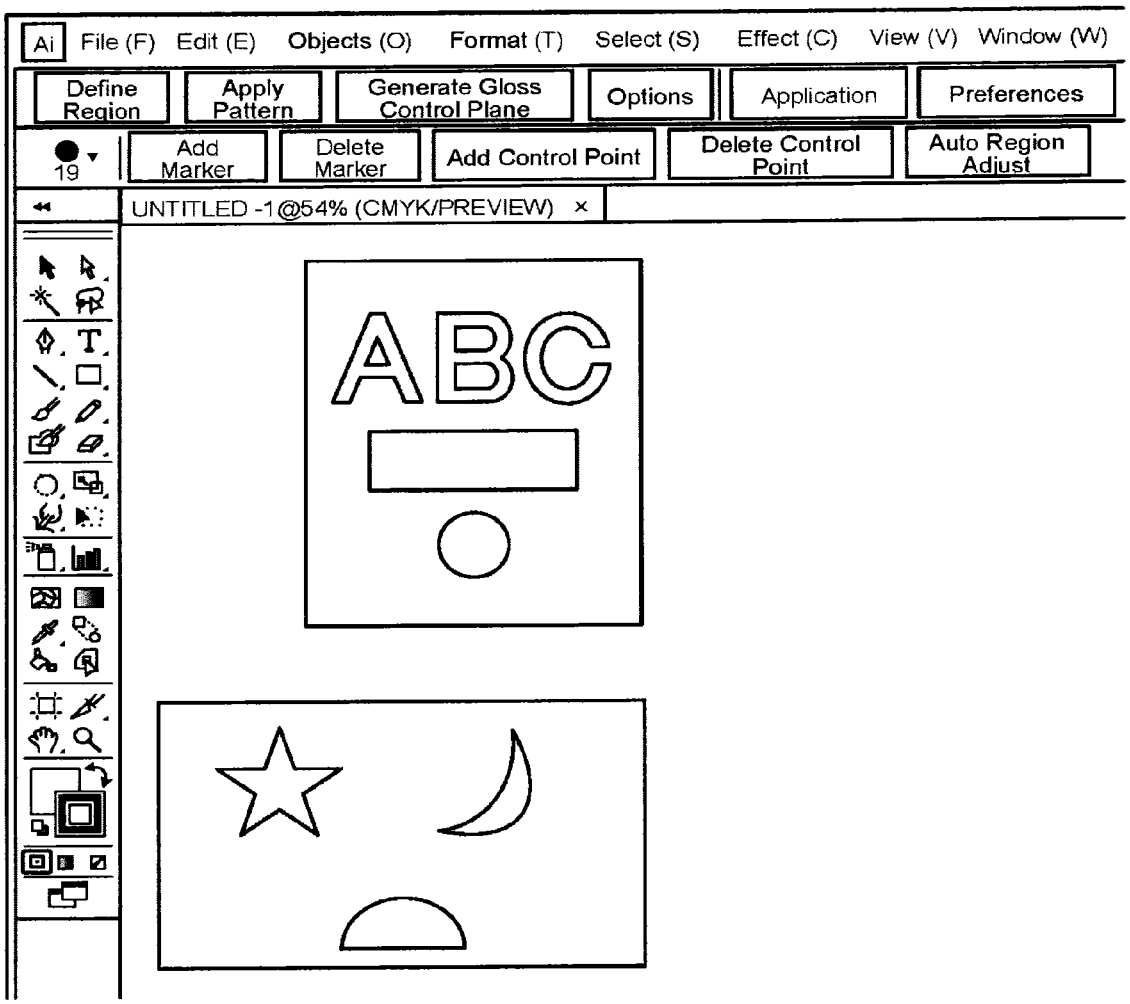
FIG. 7 is a diagram illustrating an example of an image to be displayed by the host apparatus of the first embodiment when accepting input operations.
Figure 8:
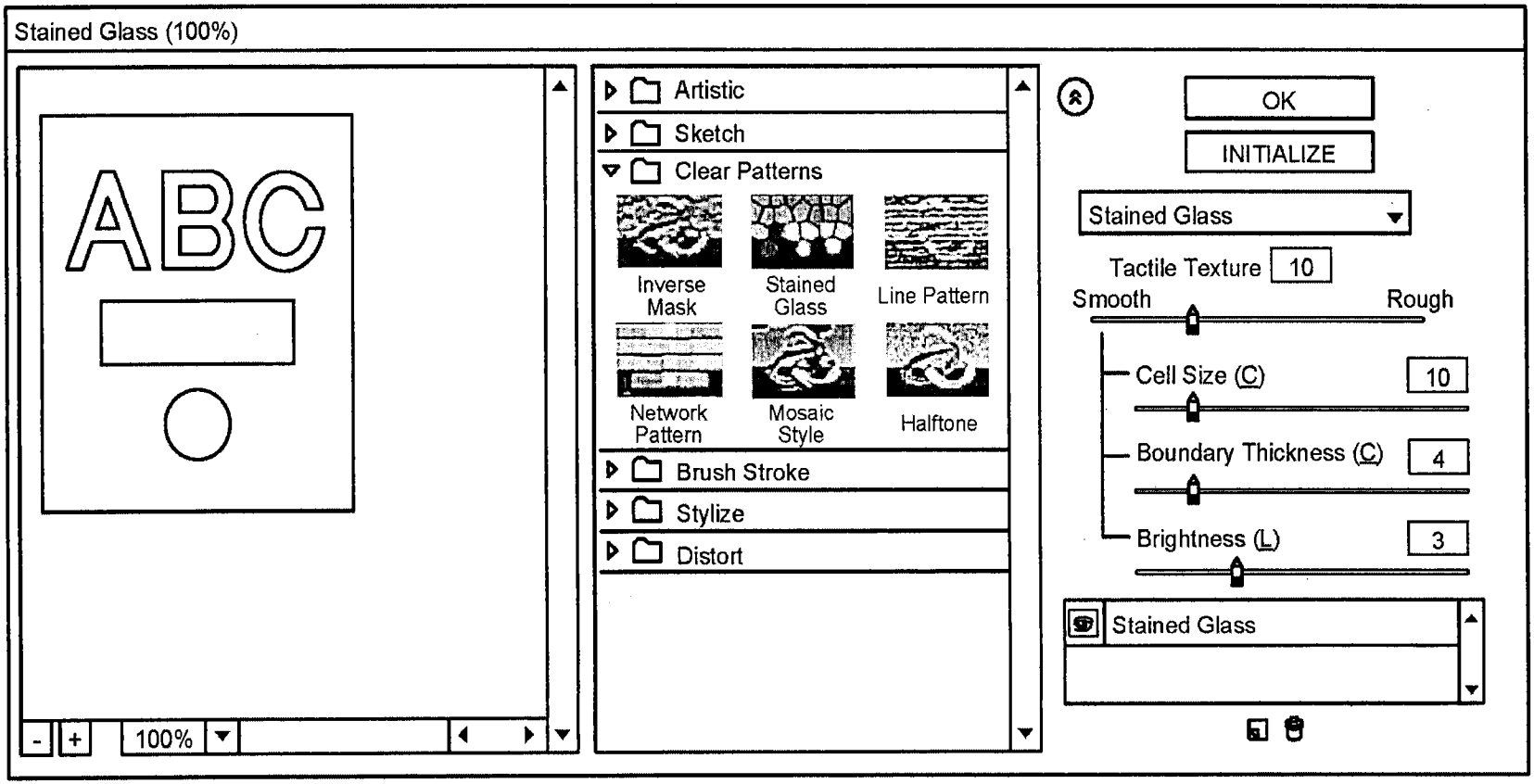
FIG. 8 is a diagram illustrating an example of an image to be displayed by the host apparatus of the first embodiment when accepting surface-effect specification information through input operations.

Accepting user's input of surface-effect specification information is described below with reference to FIGS. 7 and 8. FIG. 7 is a diagram illustrating an example of an image to be displayed by the host apparatus 10 of the first embodiment when accepting input operations. FIG. 8 is a diagram illustrating an example of an image to be displayed by the host apparatus 10 of the first embodiment when accepting surface-effect specification information provided through input operations.

FIG. 7 illustrates an example of an image displayed in a case where a plugin is installed in Illustrator (registered trademark) marketed by Adobe Systems Incorporated. In the example illustrated in FIG. 7, an image represented by color-plane image data is displayed. A region to which surface effect is to be applied is specified by a user by pressing, with the input unit 203, an "Add Marker" button which is an input operation for specifying the region to which the surface effect is desired to be applied. The user performs such an input operation as that described above on every region to which surface effect is to be applied. The display control unit 213 of the host apparatus 10 causes the display unit 204 to display such an image as that illustrated in FIG. 8 for each of the specified regions.

The example illustrated in FIG. 8 includes image information presenting regions specified as regions to which surface effect is to be applied and display information for accepting inputs of surface-effect specification information. The input unit 203 accepts input operations specifying a type of surface effect for each of regions to which surface effect is to be applied. The premium gloss and the gloss presented in FIG. 3 are denoted as "Inverse Mask" in FIG. 8. Other effects in FIG. 8 than the premium gloss and the gloss, which are presented in FIG. 3, are denoted as "Stained Glass", "Line Pattern", "Network Pattern", "Mosaic Style", and "Halftone".

Referring back to FIG. 6, the image processing unit 212 performs image processing based on user's input accepted by the input unit 203.

The plane-data generating unit 214 generates color-plane image data, gloss-control-plane image data, and clear-plane image data. More specifically, when the input control unit 124 receives information specifying colors of drawing objects contained in the image from the input unit 203, the plane-data generating unit 214 generates the color-plane image data in accordance with the information specifying the colors.

When the input control unit 124 receives information specifying transparent images such as a watermark or a texture other than the surface effect and regions to which the transparent images are to be applied from the input unit 203, the plane-data generating unit 214 generates the clear-plane image data indicating the transparent images and the regions to which the transparent images are to be applied on transfer paper in accordance with the information specifying the regions.

When surface-effect specification information (information indicating regions to which surface effect is to be applied and types of the surface effect) from the input unit 203 is received by the input control unit 124, the plane-data generating unit 214 generates the gloss-control-plane image data indicating the regions to which surface effect is to be applied on the transfer paper and the surface effect types in accordance with the surface-effect specification information. The plane-data generating unit 214 generates the gloss-control-plane image data which specifies the regions to which surface effect indicated by gloss control values is to be applied on a per-drawing-object basis of the image data representing the target image.

Figures 9, 10:
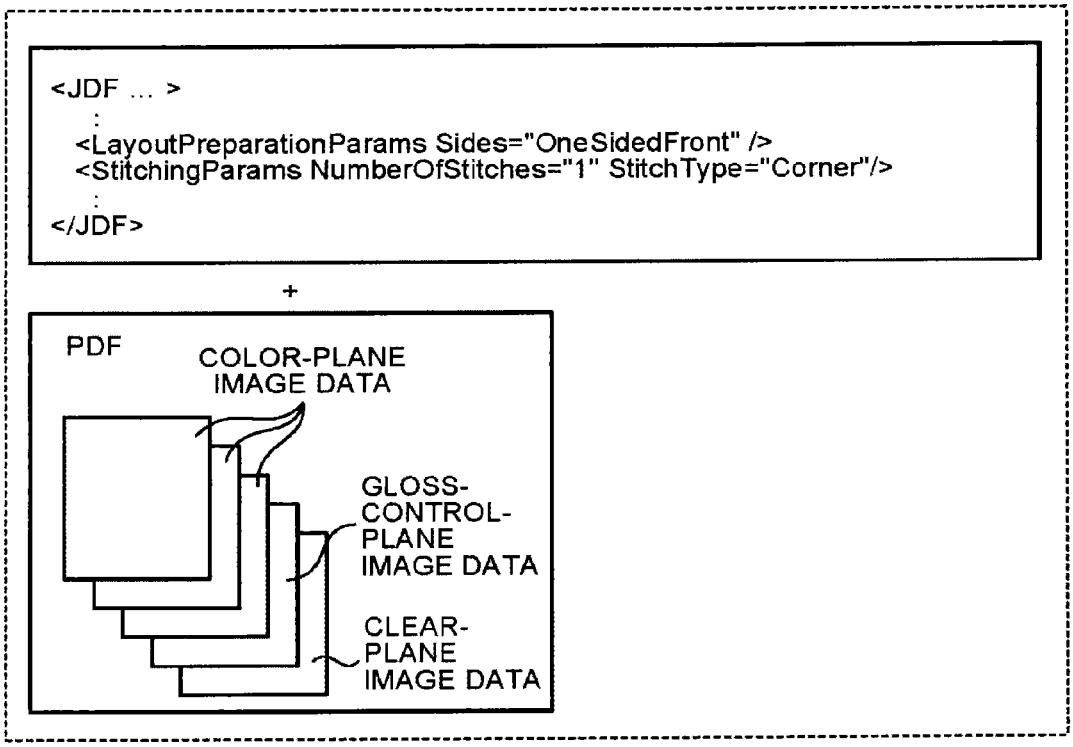
FIG. 9 is a diagram illustrating an example of density-value choice information of the first embodiment.
FIG. 10 is a diagram schematically illustrating an example structure of print data of the first embodiment.

The storage unit 202 stores density-value choice information containing user-specified surface effect types and gloss-control-plane density values which depend on the surface effect types. FIG. 9 is a diagram illustrating an example of the density-value choice information of the first embodiment. Referring to the example illustrated in FIG. 9, the density value of regions to which "PG" (premium gloss) is assigned by a user is "98%". The density value of regions to which "G" (gloss) is assigned is "90%". The density value of regions to which "M" (matte) is assigned is "16%".

The density-value choice information is a part of surface-effect choice information (see FIG. 15 which will be described later) stored in the DFE 50. The control unit 205 obtains the surface-effect choice information at predetermined timing, generates the density-value choice information from the surface-effect choice information, and stores the density-value choice information in the storage unit 202. Alternatively, the density-value choice information may be generated as follows. The surface-effect choice information is stored in a storage server (on a cloud system) on a network such as the Internet in advance. The control unit 205 obtains the surface-effect choice information from the server and generates the density-value choice information from the surface-effect choice information. Note that the surface-effect choice information stored in the DFE 50 should be same data as the surface-effect choice information stored in the storage server (on the cloud system).

Referring back to FIG. 6, the plane-data generating unit 214 generates the gloss-control-plane image data by setting the density values (gloss control values) of the drawing objects, to which the surface effect is assigned by user, to values which depend on the surface effect types by consulting the density-value choice information illustrated in FIG. 9.

Assume that, for example, a user assigns "PG" to the region where "ABC" is displayed, assigns "G" to the rectangular region, and assigns "M" to the circular region of the color-plane image data illustrated in FIG. 2. In this case, the plane-data generating unit 214 generates the gloss-control-plane image data by setting the density value of the drawing object ("ABC") to which "PG" is assigned by the user to "98%", setting the density value of the drawing object ("rectangle")

to which "G" is assigned to "90%", and setting the density value of the drawing object ("circle") to which "M" is assigned to "16%".

The gloss-control-plane image data generated by the plane-data generating unit 214 is data in a vector format which describes an image as a set of drawing objects indicating coordinates of points, parameters of expressions describing lines and surfaces formed by connecting the points, solid color portions, special effects, and the like. FIG. 4 is a conceptual image of the gloss-control-plane image data. The plane-data generating unit 214 generates document data by combining the gloss-control-plane image data, the color-plane image data, and the clear-plane image data and passes the document data to the print-data generating unit 215.

The print-data generating unit 215 generates print data from the document data. The print data contains at least color-plane image data and a job command, and may further contain gloss-control-plane image data and/or clear-plane image data. The job command includes, for example, information for applying printer preferences and settings related to multiple-page-in-one-sheet printing and duplex printing to a printer.

FIG. 10 is a diagram schematically illustrating an example structure of print data of the first embodiment. In the example illustrated in FIG. 10, job definition format (JDF) is used as the job command. However, the job command is not limited to JDF but may be any job command. The JDF illustrated in FIG. 10 is a command designating "one-sided printing and stapling" as settings related to multiple-page-in-one-sheet printing. The print data may be converted to a page description language (PDL), such as PostScript (registered trademark). The print data may remain in the PDF format if the PDF format is supported by the DFE 50.

Figure 11:
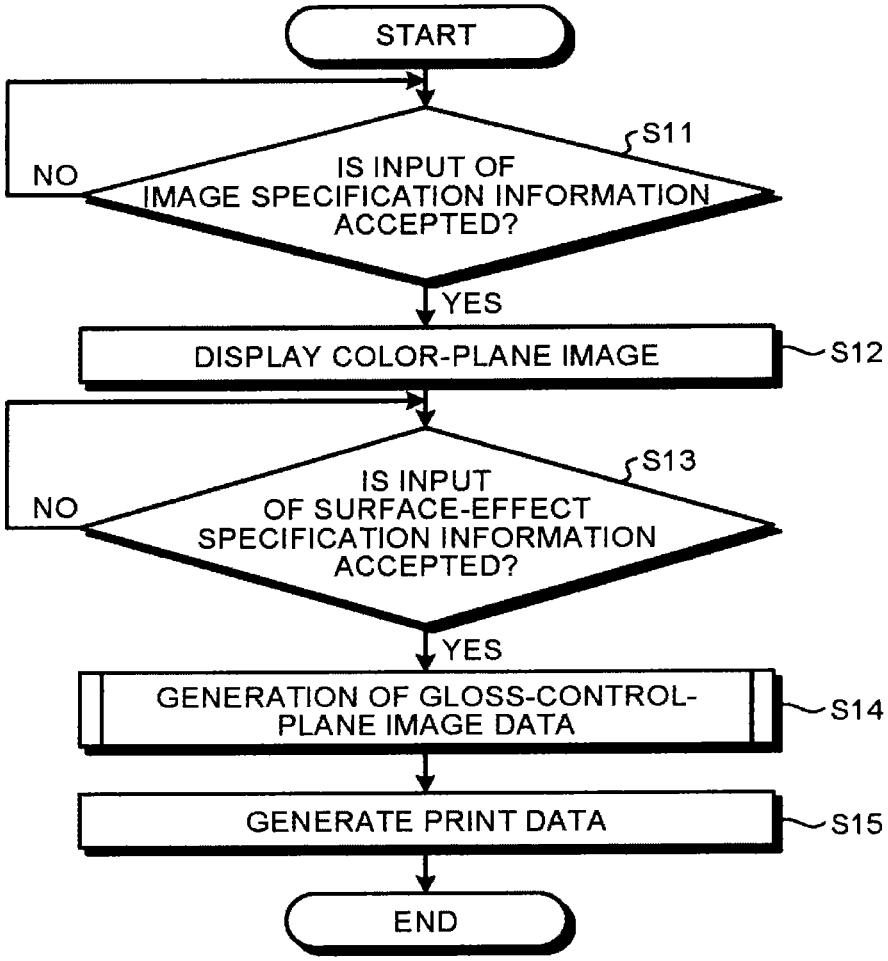
FIG. 11 is a flowchart illustrating a method to be followed by the host apparatus of the first embodiment in producing print data.

Operations through which the host apparatus 10 generates print data are described below. FIG. 11 is a flowchart illustrating a method to be followed by the host apparatus 10 of the first embodiment in producing print data. Illustrated in FIG. 11 is an example case where a transparent image is not specified and therefore the clear-plane image data is not to be generated.

If input of image specification information is accepted by the input control unit 211 (Yes at Step S11), the display control unit 213 controls the display unit 204 so as to display a color-plane image specified by the accepted image specification information (Step S12). If no input of image specification information is accepted by the input control unit 211 (No at Step S11), the display control unit 213 waits for the input control unit 211 to accept input of image specification information.

If input of surface-effect specification information is accepted by the input control unit 211 (Yes at Step S13), the plane-data generating unit 214 generates gloss-control-plane image data based on the accepted surface-effect specification information (Step S14). If no input of surface-effect specification information is accepted by the input control unit 211 (No at Step S12), the display control unit 213 waits for the input control unit 211 to accept input of surface-effect specification information.

Figures 12, 13:
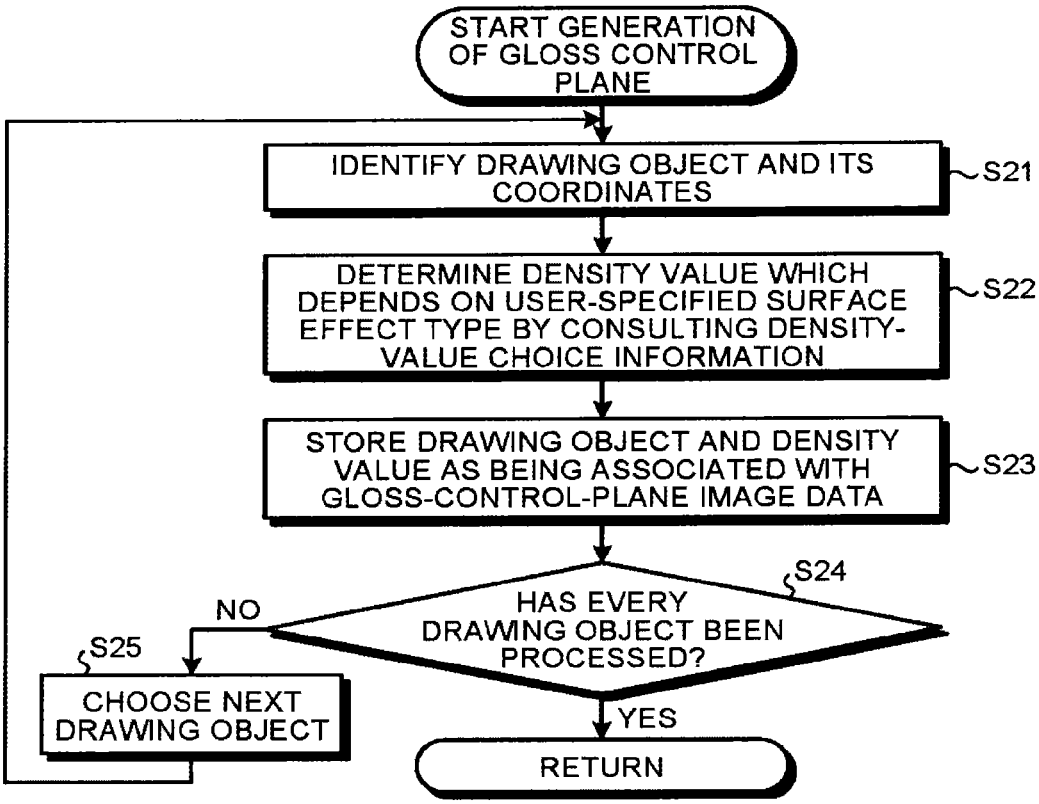
FIG. 12 is a flowchart illustrating a method to be followed by the host apparatus of the first embodiment in producing gloss-control-plane image data.
FIG. 13 is a diagram illustrating relationship between drawing objects, coordinates, and density values of the gloss-control-plane image data illustrated in FIG. 4.

The process of generating gloss-control-plane image data at Step S14 is described in detail below. FIG. 12 is a flowchart illustrating a method to be followed by the host apparatus 10 of the first embodiment in producing gloss-control-plane image data. The plane-data generating unit 214 identifies, based on the surface-effect specification information, a drawing object to which surface effect is assigned and coordinates of the drawing object in the image (Step S21). The drawing object and the coordinates can be identified using, for example, a drawing command for use by the image processing unit 212 in drawing the drawing object and coordinate values involved in the drawing command. The drawing command may be provided by the operating system, for example.

The plane-data generating unit 214 determines a density value gloss control value), which depends on the user-specified surface effect type in the surface-effect specification information, by consulting the density-value choice information stored in the storage unit 202 (Step S22).

The plane-data generating unit 214 stores the drawing object and the density value, which is determined based on the surface effect type, as being associated with the gloss-control-plane image data (which is initially null) (Step S23).

The plane-data generating unit 214 determines whether or not the operations at Step S21 through Step S23 have been performed on every drawing object belonging to the image (Step S24). If there is a drawing object which is not processed yet (No at Step S24), the plane-data generating unit 214 chooses a next drawing object that is not processed yet in the image (Step S25) and performs the operations at Step S21 through Step S23.

If it is determined that the operations at Step S21 through Step S23 has been performed on every drawing object in the image (Yes at Step S24), generation of the gloss-control-plane image data is completed. The gloss-control-plane image data (see FIG. 4) in accordance with the surface-effect specification information accepted using the image illustrated in FIG. 8 has thus been generated. FIG. 13 is a diagram illustrating relationship between drawing objects, coordinates, and density values of the gloss-control-plane image data illustrated in FIG. 4. FIG. 13 shows that, for example, the coordinates indicating the position of the drawing object "A,B,C" are "(x1,y1)-(x2,y2)", and a density value of the region identified by the coordinates is 98%.

Referring back to FIG. 11, when the gloss-control-plane image data has been generated, the plane-data generating unit 214 generates document data by combining the gloss-control-plane image data and the color-plane image data, and passes the document data to the print-data generating unit 215. The print-data generating unit 215 generates print data from the document data (Step S15).

Figure 14:
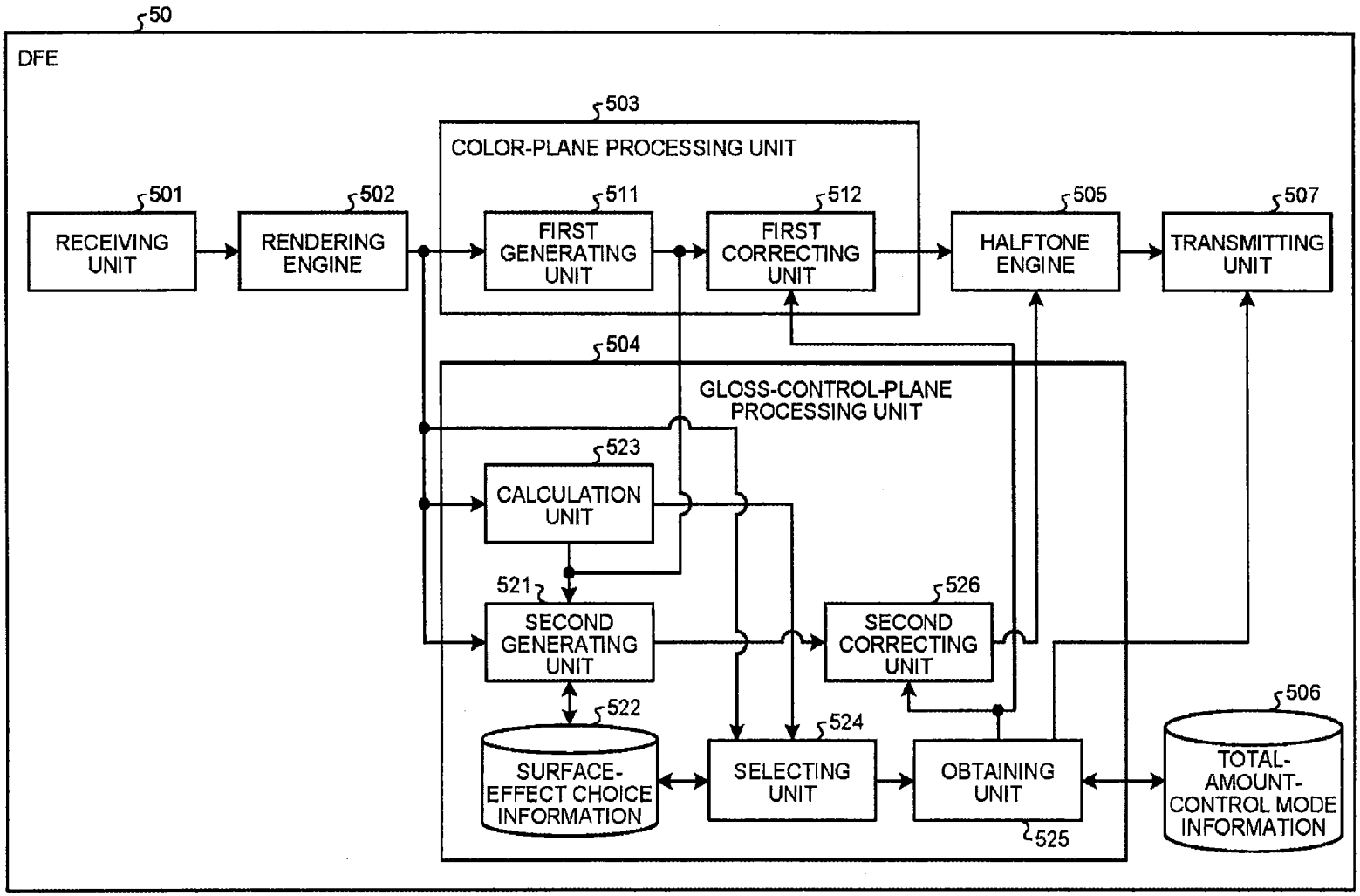
FIG. 14 is a diagram illustrating an example configuration of a DFE of the first embodiment.

The configuration of the DFE 50 is described below. FIG. 14 is a diagram illustrating an example configuration of the DFE 50 of the first embodiment. The DFE 50 of the first embodiment includes a receiving unit 501, a rendering engine 502, a color-plane processing unit 503, a gloss-control-plane processing unit 504, a halftone engine 505, total-amount-control mode information 506, and a transmitting unit 507. The color-plane processing unit 503 includes a first generating unit 511 and a first correcting unit 512. The gloss-control-plane processing unit 504 includes a second generating unit 521, surface-effect choice information 522, a calculation unit 523, a selecting unit 524, an obtaining unit 525, and a second correcting unit 526. The DFE 50 stores the surface-effect choice information 522 and the total-amount-control mode information 506 in a storage unit (which is not shown in FIG. 14).

The receiving unit 501 receives the print data described above from the host apparatus 10. In the description below, it is assumed that the print data received by the DFE 50 does not contain the clear-plane image data which is referred to in the description about the host apparatus 10. Meanwhile, the print data received by the DFE 50 contains at least color-plane image data and further contains, in a case where surface effect is to be applied to an image, gloss-control-plane image data. The receiving unit 501 transmits the received print data to the rendering engine 502.

The rendering engine 502 interprets the print data (the color-plane image data or the gloss-control-plane image data) and converts the print data from a vector format into a raster format. Rendering resolution can be 1,200 dpi, for example. The rendering engine 502 performs color space conversion from the RGB color space or the like to into the CMYK color space. The rendering engine 502 outputs color-plane image data which represents density values per pixel with 8 bits per color of CMYK ((1,200 dpi)*(8 bits)*(4 planes)), and transmits the color-plane image data to the first generating unit 511. The rendering engine 502 outputs gloss-control-plane image data which represents density values per pixel with 8 bits ((1,200 dpi)*(8 bits)*(1 plane)), and transmits the gloss-control-plane image data to the second generating unit 521, the calculation unit 523, and the selecting unit 524.

The first generating unit 511 receives the color-plane image data which represents density values per pixel with 8 bits from the rendering engine 502. The first generating unit 511 generates the color-toner image data described above by applying gamma correction to the color-plane image data using a 1D-LUT (one-dimensional lookup table) which is generated through a calibration method. The first generating unit 511 transmits the color-toner image data to the second generating unit 521 and the first correcting unit 512.

The second generating unit 521 receives the gloss-control-plane image data which represents density values per pixel with 8 bits from the rendering engine 502. The second generating unit 521 also receives the color-toner image data from the first generating unit 511. The second generating unit 521 generates clear-toner image data from the gloss-control-plane image data by consulting the surface-effect choice information 522. Meanwhile, the color-toner image data is consulted for the surface effect types by the second generating unit 521 in generation of the clear-toner image data. The surface-effect choice information 522 is described below.

FIG. 15 is a diagram illustrating an example of the surface-effect choice information 522 of the first embodiment. The surface-effect choice information 522 has fields of density (%), density value (representative value, numerical range), effect, forms (glosser, printer, low-temperature fixing machine), total-amount control mode, and priority level.

The density (%) is information indicating how glossy the surface effect is. In the example illustrated in FIG. 15, the density (%) is decremented by 2%. The density value (representative value, numerical range) is information expressing the density (%) by numerical values from 0 to 255. The numerical range is a range of density values in each 2% range of the density. The representative value is a representative density value in each of the numerical ranges. The effect is information indicating what type of surface effect is associated with each of the 2% ranges of the density (%).

The glosser, the printer, and the low-temperature fixing machine are information indicating how clear toner is to be deposited to give the corresponding effect. The total-amount control mode indicates a type of mode, which is a combination of a total-amount limit value and a printing speed. The total-amount limit value is an upper limit of a recording amount of the developing materials. The priority level indicates an ordinal rank according to which, in a case where two or more types of surface effect are to be applied to a region on a recording member, which one of total-amount control modes of the surface effect types is to be applied is determined. The total-amount-control mode information 506 which stores multiple total-amount control modes is described below.

FIG. 16 is a diagram illustrating an example of the total-amount-control mode information 506 of the first embodiment. The total-amount-control mode information 506 has fields of total-amount control mode, total-amount limit value, and engine speed. The total-amount control mode indicates a type of the total-amount control mode. The total-amount limit value indicates a level of the total-amount limit value. The engine speed indicates a printing speed of the printer 70. In the example illustrated in FIG. 16, there are three total-amount control modes (A, B, and C).

Description goes back to that about the surface-effect choice information 522 with reference to FIG. 15. The total-amount control modes and the priority levels illustrated in FIG. 15 are described below. Generally, the slower the engine speed, the higher gloss surface effect can be produced, while the faster the engine speed, the higher matte surface effect can be produced. For this reason, it is desirable to associate a combination of a large total-amount limit value and a low engine speed with gloss effect such as the premium gloss and the gloss. Similarly, it is desirable to associate a combination of a small total-amount limit value and a high engine speed with gloss effect such as frosted or matte finish. The reason why higher priority levels are assigned to gloss effects such as the premium gloss and the frosted finish is as follows. It is highly possible that each of the premium gloss and the gloss cannot produce a sufficient gloss effect unless otherwise in a recommended total-amount control mode. In addition, it is likely that the premium gloss and the gloss are more demanded by users than the other effects.

In the surface-effect choice information 522, a surface effect type is assigned to each of the 2% ranges of the density (%). More specifically, surface effect (the premium gloss and the gloss) which enhances gloss is associated with a range of density values (from "212" to "255") where the density percentage is 84% or higher. Surface effect (the matte) which reduces gloss is associated with a range of density values (from "1" to "43") where the density percentage is 16% or lower. Surface effect such as a texture or a background watermark is associated with a range of the density values where the density percentage is between 20% and 80%.

More specifically, as the surface effect, three different types of the mirror-like gloss (premium gloss (PG)) are associated with pixel values from "238" to "255" in such a manner that a first type of the premium gloss is associated with pixel values from "238" to "242", a second type is associated with pixels values from "243" to "247", and a third type is associated with pixel values from "248" to "255". Four different types of the normal gloss (gloss (G)) are associated with pixel values from "212" to "232" in such a types that a first type of the gloss is associated with pixel values from "212" to "216", a second type is associated with pixel values from "217" to "221", a third type is associated with pixel values from "222" to "227", and a fourth type is associated with pixel values from "228" to "232". Four different types of the dot pattern matte (matte (M)) are associated with pixel values from "23" to "43" in such a manner that a first type of the dot pattern matte is associated with pixel values from "23" to "28, a second type is associated with pixel values from "29" to "33", a third type is associated with pixel values from "34" to "38", and a fourth type is associated with pixel values from "39" to "43". "None" of surface effect is assigned to the density value of "0".

The forms fields of the surface-effect choice information 522 are described below. Referring to the example illustrated in FIG. 15, for instance, when a density value falls within the range from "248" to "255", the form of the clear-toner image data to be generated by the second generating unit 521 is the inverse mask A, and the glosser and the printer 70 are to be used.

The inverse masks are described below. An inverse mask is image data created by the second generating unit 521 for a region, to which surface effect is to be applied, by calculating a sum of per-color CMYK density values of color-toner image data expressing the region and subtracting the sum from a predetermined value. The inverse mask is used to equalize total recording (deposited) amounts of the CMYK toners and the clear toner per pixel across the entire region where the surface effect is to be applied.

Example methods for creating an inverse mask are described below. The following is a first example of the inverse mask:

$$Clr=100-(C+M+Y+K) \text{ for } Clr\geq 0$$

$$Clr=0 \text{ otherwise,} \quad (1)$$

where Clr, C, M, Y, and K are a density percentage (%) of the clear toner and density percentages (%) of the C, M, Y, and K color toners, respectively, which are obtained by converting per-pixel density values (0 to 255). The inverse mask created using Equation (1) allows, when a total of recording amounts of the CMYK toners is 100% or lower, making the toner recording amount, which is a total of the recording (deposited) amounts of the color toners and the recording (deposited) amount of the clear toner on a region where the surface effect is to be applied, 100%.

Meanwhile, in a case where the total of the recording amounts of the CMYK color toners is 100% or higher, the value of Clr is 0, and therefore the density percentage of the clear toner is 0%. However, it is possible to enhance gloss even when the density percentage of the clear toner is 0% in a case where the total of the recording amounts of the CMYK color toners is 100% or higher. This is because a portion where the total the recording amounts of the CMYK color toners exceeds 100% is smoothed out by a fixing process. By being smoothed, surface unevenness of the region resulting from variation in the toner recording amount is leveled out, which increases an amount of specularly reflected light or, in other words, gloss.

Meanwhile, other values than 100(%) may be put on the right-hand side of Equation (1).

The following is a second example of the inverse mask:

$$Clr=100 \quad (2)$$

where Clr of Equation (2) is a density percentage (%) of the clear toner obtained by converting per-pixel density values (0 to 255). The inverse mask created using Equation (2) allows depositing the clear toner uniformly on the pixels. Such an inverse mask which causes the clear toner to be uniformly deposited on pixels is referred to as a solid mask. Meanwhile, other values than 100(%) may be put on the right-hand side of Equation (2).

The following is a third example of the inverse mask:

$$Clr=100\times\{(100-C)/100\}\times\{(100-M)/100\}\times\{(100-Y)/100\}\times\{(100-K)/100\}, \quad (3)$$

where Clr, C, M, Y, and K of Equation (3) are a density percentage (%) of the clear toner and density percentages (%) of the C, M, Y, and K color toners, respectively, which are obtained by converting per-pixel density values (0 to 255). In Equation (3), (100−C)/100 is a ratio of exposed background area (hereinafter, "exposed background ratio") of C; (100−M)/100 is an exposed background ratio of M; (100−Y)/100 is an exposed background ratio of Y; (100−K)/100 is an exposed background ratio of K.

Description goes back to that about the surface-effect choice information 522 with reference to FIG. 15. An inverse mask 1 used for density values in the range from "228" to "232" is created by the second generating unit 521 by using Equation (1) described above, for example. An inverse mask is used to increase the amount of clear toner to be deposited in such a manner that the smaller the amount of the CMYK color toners on a region, the larger the amount of the clear toner to be deposited on the region. This is because, whereas a certain level of gloss is produced by influence of the CMYK toners in a region where the amount of the CMYK toners is large, a level of gloss in a region where the amount of the CMYK toner is small is low. An inverse mask causes no clear toner to be deposited on a region where the amount of the CMYK color toners is large.

The DFE 50 may hold multiple variations of the surface-effect choice information 522 each optimized for each of groups (e.g., coated paper or matte paper) of the recording member. Holding such multiple variations allows the DFE 50 to perform print control optimized depending on the recording member for use in printing.

Referring back to FIG. 14, the second generating unit 521 transmits the clear-toner image data generated by consulting the surface-effect choice information 522 to the second correcting unit 526.

The calculation unit 523 receives the gloss-control-plane image data which represents density values per pixel with 8 bits from the rendering engine 502. The calculation unit 523 calculates an area of a same-density-value region having a same density value (region to which a same surface effect is to be applied) (hereinafter, sometimes referred to as "same-surface-effect region") for each of same-density-value regions in the gloss-control-plane image data. The calculation unit 523 calculates an area ratio expressed as ((the area of the same-density-value region)/(area of the entire image)) for each of the same-density-value regions. The calculation unit 523 transmits area-ratio information indicating the area ratios of the same-density-value regions to the selecting unit 524.

The selecting unit 524 receives the gloss-control-plane image data which represents density values per pixel with 8 bits from the rendering engine 502 and receives the area-ratio information from the calculation unit 523. The selecting unit 524 selects a total-amount control mode for use in printing the clear-toner image data based on the gloss-control-plane image data, the priority level defined in the surface-effect choice information 522, and the area-ratio information. More specifically, the selecting unit 524 determines, for each of the surface effect types, whether or not the area ratio of the same-surface-effect region on the recording member is equal to or higher than a predetermined threshold in the ascending order of the priority levels. The selecting unit 524 selects a total-amount control mode where the area ratio of the same-surface-effect region on the recording member is equal to or higher than the predetermined threshold as the total-amount control mode for use in printing the clear-toner image data. Any desired value can be used as the predetermined threshold. In the first embodiment, the DPE 50 sets the predetermined threshold to 10%.

A method to be followed by the selecting unit 524 in selecting total-amount control modes for use in printing the clear-toner image data is specifically described below with reference to FIGS. 17 and 18.

FIG. 17 illustrates an example where an image contains a circular region, to which the premium gloss is to be applied as surface effect, and a rectangular region, to which the matte is to be applied as surface effect. The selecting unit 524 identifies the total-amount control mode (A) and the priority level (1st) of the premium gloss by consulting the surface-effect choice information 522. Similarly, the selecting unit 524 identifies the total-amount control mode (C) and the priority level (4th) of the matte by consulting the surface-effect choice information 522. The selecting unit 524 identifies an area ratio (20%) of the circular region to which the premium gloss is to be applied and an area ratio (25%) of the rectangular region to which the matte is to be applied by consulting the area-ratio information. The area ratio (20%) of the circular region to which the premium gloss is to be applied is higher than the predetermined threshold (10%). Accordingly, the selecting unit 524 selects the total-amount control mode (A) of the premium gloss as the total-amount control mode for use in printing this page.

FIG. 18 illustrates an example where an image contains a circular region, to which the premium gloss is to be applied as surface effect, and a rectangular region, to which the matte is to be applied as surface effect. The selecting unit 524 identifies the total-amount control mode (A) and the priority level (1st) of the premium gloss by consulting the surface-effect choice information 522. Similarly, the selecting unit 524 identifies the total-amount control mode (C) and the priority level (4th) of the matte by consulting the surface-effect choice information 522. The selecting unit 524 identifies an area ratio (3%) of the circular region to which the premium gloss is to be applied and an area ratio (25%) of the rectangular region to which the matte is to be applied by consulting the area-ratio information. The area ratio (3%) of the circular region to which the premium gloss is to be applied is lower than the predetermined threshold (10%). Accordingly, the selecting unit 524 determines whether or not the area ratio (25%) of the matte which is the second highest in the priority level is equal to or higher than the predetermined threshold (10%). The area ratio (25%) of the matte is higher than the predetermined threshold (10%). Accordingly, the selecting unit 524 selects the total-amount control mode (C) of the matte as the total-amount control mode for use in printing this page.

Unit on which basis the selecting unit 524 selects total-amount control modes for use in printing transparent-developing-material image data is described below. The selecting unit 524 may select total-amount control modes on a desired unit basis. The unit may be determined as follows, for example. The host apparatus 10 accepts an input specifying a unit on which basis total-amount control modes are to be switched, and transmits print data and information indicating the unit on which basis total-amount control modes are to be switched to the DFE 50. The DFE 50 (more particularly, the selecting unit 524) determines the unit on which basis total-amount control modes are to be switched based on the information. The unit on which basis the selecting unit 524 selects total-amount control modes is specifically described below with reference to FIGS. 19 to 22.

Figure 19:
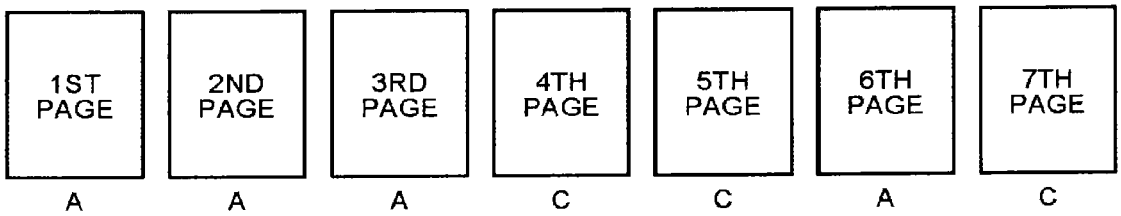
FIG. 19 is a diagram illustrating an example of unit on which basis a selecting unit of the first embodiment selects total-amount control modes.

FIG. 19 illustrates an example where the selecting unit 524 selects total-amount control modes on a per-page basis. Although desired gloss effect can be obtained in each of pages, in a case where, for example, a total-amount control mode is changed alternately on a per-page basis, productivity can be decreased by frequent switching of the total-amount limit value and the engine speed. In the example illustrated in FIG. 19, the selecting unit 524 selects A as the total-amount control mode for the 1st to 3rd pages, selects C as the total-amount control mode for the 4th and 5th pages, selects A as the total-amount control mode for the 6th page, and selects C as the total-amount control mode for the 7th page.

Figure 20:
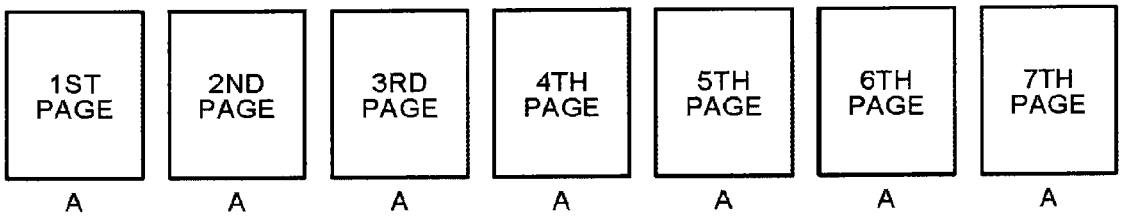
FIG. 20 is a diagram illustrating another example of the unit on which basis the selecting unit of the first embodiment selects total-amount control modes.

FIG. 20 illustrates an example where the selecting unit 524 selects total-amount control modes on a per-job basis. The selecting unit 524 selects total-amount control modes on a per-page basis of print pages contained in a single job as illustrated in FIG. 19 first. The selecting unit 524 counts, for each type of the total-amount control mode, the number of pages to which the total-amount control mode type is applied. FIG. 19 illustrates an example where the number of pages to which the total-amount control mode (A) is applied is four and the number of pages to which the total-amount control mode (C) is applied is three. Accordingly, the selecting unit 524 selects the total-amount control mode (A) that is the largest in the number of applied pages as the total-amount control mode for the single print job. In a case where two or more types of the total-amount control mode are the largest in the number of applied pages, the selecting unit 524 selects a total-amount control mode which is the largest in total-amount limit value and the lowest in engine speed to achieve high image quality. Selecting total-amount control modes on a per-job basis is advantageous in that, because neither the total-amount limit value nor the engine speed is switched in a single job, waste of time resulting from such switching does not occur. However, a desired gloss effect may possibly not be obtained if the job contains a page where a total-amount control mode for use in printing the job differs from a recommended total-amount control mode of the page.

Figure 21:
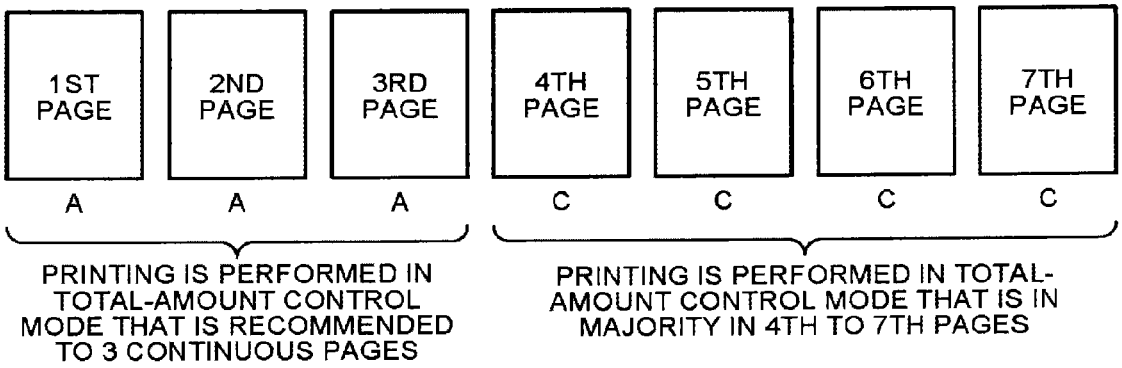
FIG. 21 is a diagram illustrating still another example of the unit on which basis the selecting unit of the first embodiment selects total-amount control modes.

FIG. 21 illustrates an example where the selecting unit 524 selects total-amount control modes on a multiple-page basis. The selecting unit 524 selects total-amount control modes on a per-page basis as illustrated in FIG. 19 first. The selecting unit 524 selects total-amount control modes on a multiple-page basis in a manner that minimizes the frequency of total-amount control mode switching. In the example illustrated in FIG. 19, the total-amount control mode for the 1st to 3rd pages is A, the total-amount control mode for the 4th, 5th, and 7th pages is C, and the total-amount control mode for the 6th page is A. Accordingly, the selecting unit 524 selects total-amount control modes on a continuous-page basis as follows. The selecting unit 524 selects A as the total-amount control mode for the 1st to 3rd pages and selects C as the total-amount control mode for the 4th to 7th pages. Selecting total-amount control modes on the continuous-page basis allows minimizing the frequency of total-amount control mode switching, thereby maintaining productivity and increasing likelihood of obtaining a desired gloss effect.

Figure 22:
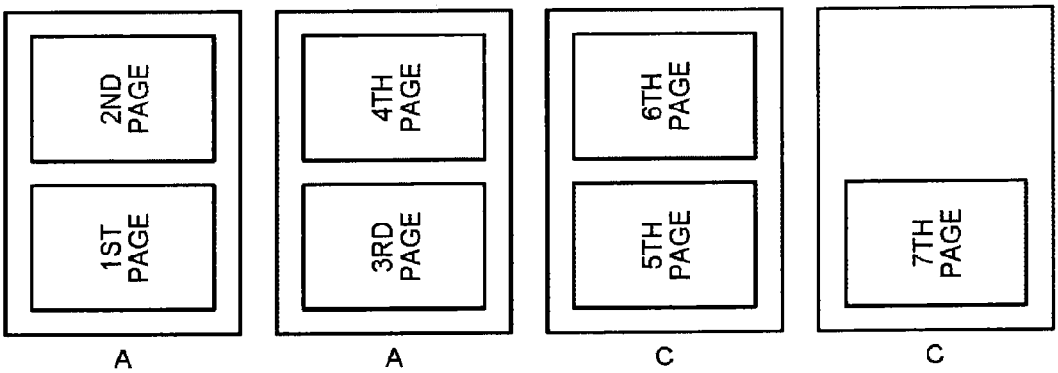
FIG. 22 is a diagram illustrating still another example of the unit on which basis the selecting unit of the first embodiment selects total-amount control modes.

FIG. 22 illustrates an example where the selecting unit 524 selects total-amount control modes on a per-sheet-containing-multiple-pages basis. FIG. 22 illustrates an example where two pages are to be printed in one sheet. The number of pages to be printed on one sheet can be any desired number. The selecting unit 524 selects total-amount control modes on a per-page basis as illustrated in FIG. 19 first without combining pages into one sheet. The selecting unit 524 selects total-amount control modes on the per-sheet-containing-multiple-pages basis in a manner that minimizes the frequency of total-amount control mode switching. In the example illustrated in FIG. 19, the total-amount control mode for the 1st through 3rd pages is A, the total-amount control mode for the 4th, 5th, and 7th pages is C, and the total-amount control mode for the 6th page is A. Accordingly, the selecting unit 524 selects total-amount control modes on the per-sheet-containing-multiple-pages basis as follows. The selecting unit 524 selects A as the total-amount control mode for the 1st and 2nd sheets and selects C as the total-amount control mode for the 3rd and 4th sheets. Alternatively, the selecting unit 524 may select A as the total-amount control mode for the 1st sheet and select C as the total-amount control mode for the 2nd to 4th sheets.

Description goes back to that about the DFE 50 with reference to FIG. 14. The selecting unit 524 transmits information indicating the total-amount control modes selected on the per-predetermined-unit basis described above to the obtaining unit 525.

The obtaining unit 525 receives the information indicating the total-amount control modes selected on the per-predetermined-unit basis from the selecting unit 524. The obtaining unit 525 obtains a total-amount limit value and an engine speed of each of the total-amount control modes from the total-amount-control mode information 506. The obtaining unit 525 transmits information indicating the total-amount limit values of the total-amount control modes selected on the per-predetermined-unit basis to the first correcting unit 512 and the second correcting unit 526. The obtaining unit 525 transmits information indicating the engine speeds of the total-amount control modes selected on the per-predetermined-unit basis to the transmitting unit 507.

The first correcting unit 512 receives the color-toner image data from the first generating unit 511 and receives information indicating the total-amount limit values of the total-amount control modes selected on the per-predetermined-unit basis from the obtaining unit 525. The first correcting unit 512 corrects the color-toner image data based on the total-amount limit values. The first correcting unit 512 transmits the corrected color-toner image data to the halftone engine 505.

The second correcting unit 526 receives the clear-toner image data from the second generating unit 521 and receives the information indicating the total-amount limit values of the total-amount control modes selected on the per-predetermined-unit basis from the obtaining unit 525. The second correcting unit 526 corrects the clear-toner image data based on the total-amount limit values. The second correcting unit 526 transmits the corrected clear-toner image data to the halftone engine 505.

Alternatively, a configuration in which only one of the first correcting unit 512 (which corrects the color-toner image data) and the second correcting unit 526 (which corrects the clear-toner image data) performs processing may be employed. If the configuration where both the first correcting unit 512 and the second correcting unit 526 perform processing is employed, by what ratio the color-toner image data and the clear-toner image data are to be corrected based on the total-amount limit values may be determined as appropriate.

The halftone engine 505 receives the corrected color-toner image data from the first correcting unit 512 and the corrected clear-toner image data from the second correcting unit 526. The halftone engine 505 performs halftoning on the color-toner image data to convert the color-toner image data into a data format which represents the color-toner image data with 2-bit (4 levels of) halftone. Similarly, the halftone engine 505 performs halftoning on the clear-toner image data to convert the clear-toner image data into a data format which expresses the clear-toner image data with 2-bit (4 levels of halftone. Note that 2-bit halftone is only an example and halftone of any bits, e.g., 1-bit halftone, may be employed. The halftone engine 505 transmits the color-toner image data and the clear-toner image data having undergone the halftoning to the transmitting unit 507.

The transmitting unit 507 receives the color-toner image data and the clear-toner image data having undergone the halftoning from the halftone engine 505 and receives the information indicating the engine speeds of the total-amount control modes selected on the per-predetermined-unit basis from the obtaining unit 525. The transmitting unit 507 transmits the color-toner image data and the clear-toner image data having undergone the halftoning and the information indicating the engine speeds of the total-amount control modes selected on the per-predetermined-unit basis to the printer 70 via the MIC 60.

Figure 23:
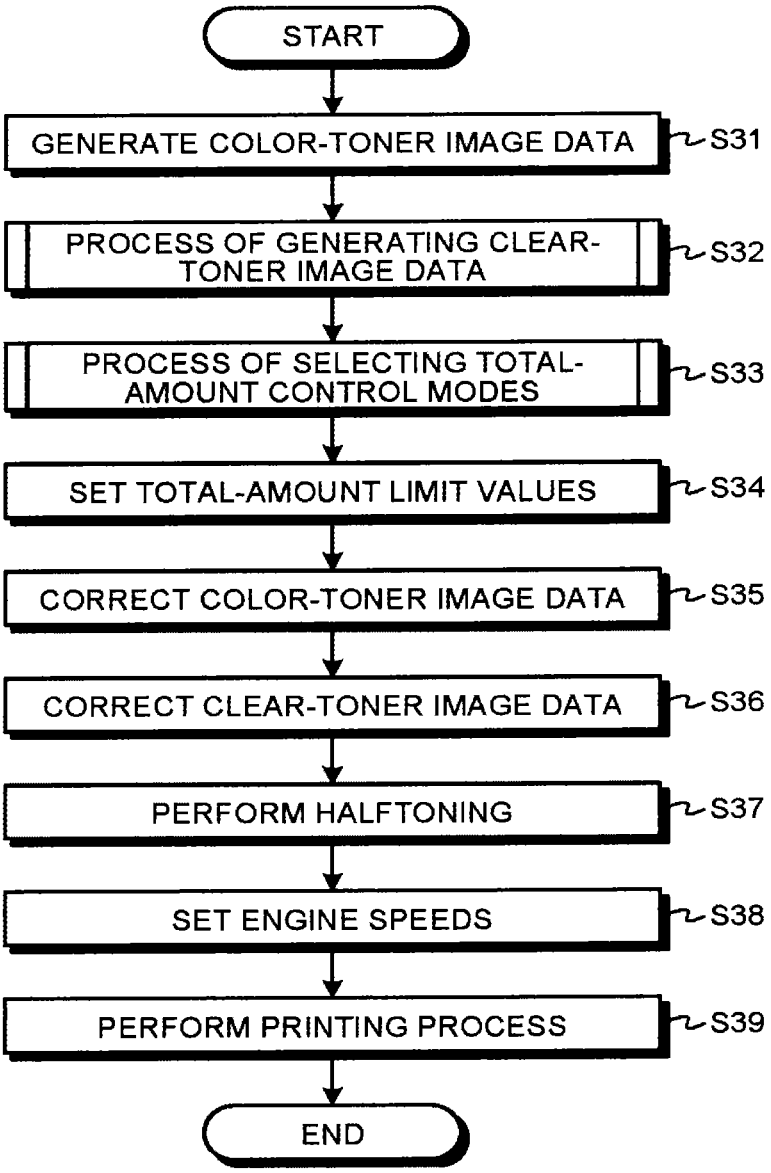
FIG. 23 is a flowchart illustrating an example of a print control method of the first embodiment.

A print control method of the first embodiment is described below with reference to a flowchart. FIG. 23 is the flowchart illustrating an example of the print control method of the first embodiment. The rendering engine 502 interprets the color-plane image data received by the receiving unit 501 and converts the data from a vector format into a raster format. The rendering engine 502 transmits the color-plane image data in the raster format to the first generating unit 511. The first generating unit 511 generates color-toner image data by applying gamma correction to the color-plane image data using the 1D-LUT which is generated through the calibration method (Step S31). The first generating unit 511 transmits the color-toner image data to the second generating unit 521 and the first correcting unit 512.

The rendering engine 502 and the second generating unit 521 perform the process of generating clear-toner image data from the gloss-control-plane image data received by the receiving unit 501 (Step S32). The process of generating clear-toner plane data is described in detail below.

Figure 24:
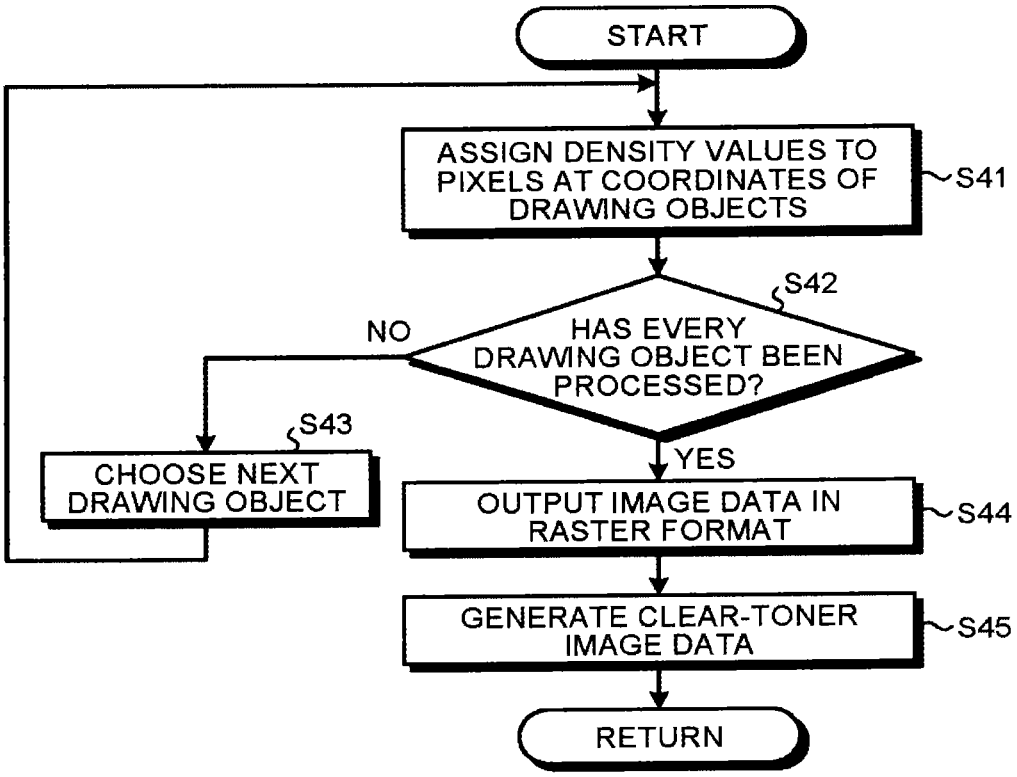
FIG. 24 is a flowchart illustrating an example procedure for a process of generating clear-toner image data of the first embodiment.

FIG. 24 is a flowchart illustrating an example procedure for the process of generating clear-toner image data of the first embodiment. The rendering engine 502 performs conversion from a data format in which density values are assigned to drawing objects (see FIG. 13) to a data format in which density values are assigned to pixels at coordinates of the drawing objects (Step S41). Put another way, the rendering engine 502 converts the data format of the gloss-control-plane image data from the vector format into the raster format.

The rendering engine 502 determines whether or not the operation at Step S41 has been performed on every drawing object (Step S42). If the operation at Step S41 has not been performed on every drawing object yet (No at Step S42), the rendering engine 502 chooses a next drawing object (Step S43) and returns to Step S41. On the other hand, if the operation at Step S41 has been performed on every drawing object (Yes at Step S42), the rendering engine 502 outputs gloss-control-plane image data in the raster format in which density values are assigned to pixels (Step S44). The second generating unit 521 receives the gloss-control-plane image data in the raster format from the rendering engine 502 and the color-toner image data of the CMYK colors from the first generating unit 511. The second generating unit 521 generates clear-toner image data from the gloss-control-plane image data in the raster format and the color-toner image data of the CMYK colors by consulting the surface-effect choice information 522 described above (Step S45).

Description goes back to that about the print control method with reference to FIG. 23. The calculation unit 523 and the selecting unit 524 perform a process of selecting total-amount control modes (Step S33). The process of selecting total-amount control modes is described in detail below.

Figure 25:
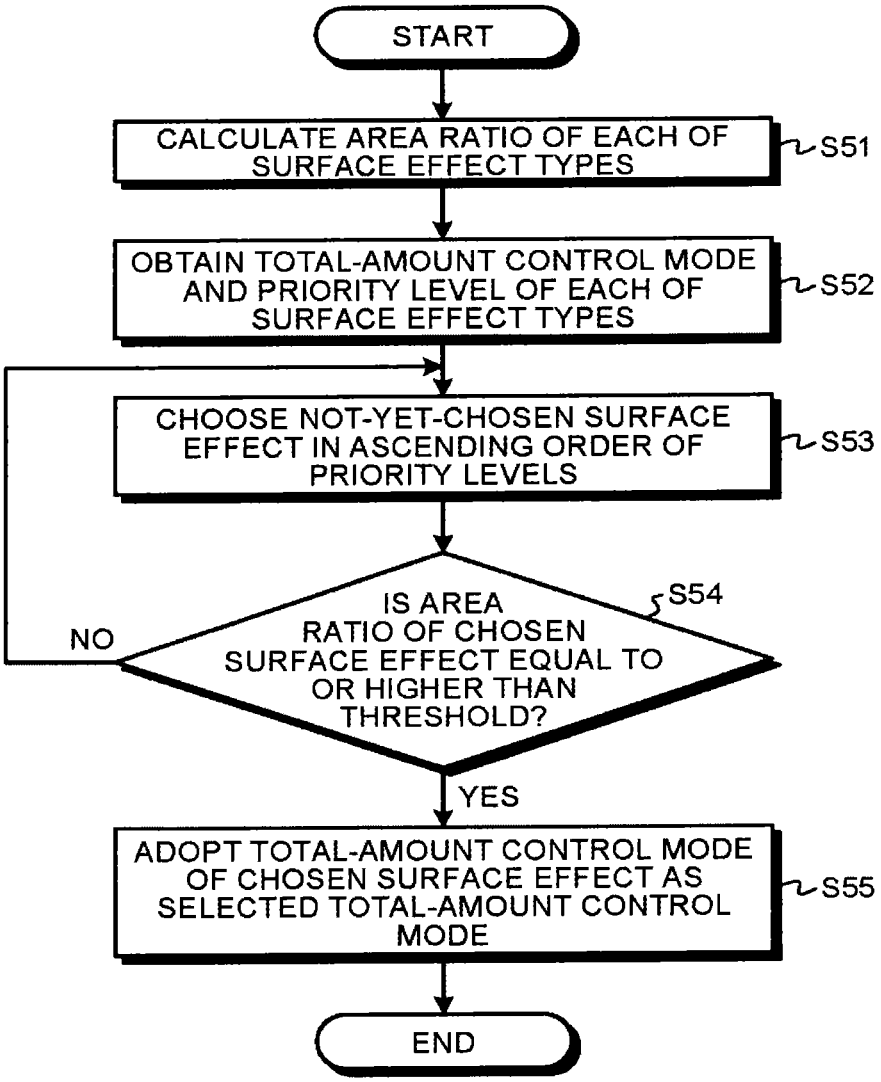
FIG. 25 is a diagram illustrating an example procedure for a process of selecting total-amount control modes of the first embodiment.

FIG. 25 is a diagram illustrating an example procedure for the process of selecting total-amount control modes of the first embodiment. The calculation unit 523 receives the gloss-control-plane image data in the raster format from the rendering engine 502. The calculation unit 523 calculates an area of a same-density-value region (same-surface-effect region) for each of same-density-value regions in the gloss-control-plane image data. The calculation unit 523 calculates an area ratio expressed as ((the area of the same-density-value region)/(area of the entire image)) for each of the same-density-value regions (Step S51). The calculation unit 523 transmits area-ratio information indicating the area ratios of the same-density-value regions to the selecting unit 524.

The selecting unit 524 receives the gloss-control-plane image data in the raster format from the rendering engine 502 and the area-ratio information from the calculation unit 523. The selecting unit 524 obtains the total-amount control mode and the priority level of each of surface effect types (i.e., each of the density values) contained in one page of the gloss-control-plane image data in the raster format from the surface-effect choice information 522 (Step S52). The selecting unit 524 chooses a not-yet-chosen surface effect in an ascending order of the priority levels (Step S53). The selecting unit 524 determines whether or not the area ratio of the surface effect chosen at Step S53 is equal to or higher than the threshold by consulting the area-ratio information (Step S54). If the area ratio is lower than the threshold (No at Step S54), the process goes back to Step S53. If the area ratio is equal to or higher than the threshold (Yes at Step S54), the total-amount control mode of the surface effect chosen at Step S53 is selected (adopted) as the total-amount control mode of this page (Step S55).

Meanwhile, any method can be used in selecting a total-amount control mode of the page in a case where none of area ratios of surface effect types in one page is equal to or higher than the threshold at Step S53 and Step S54. For example, the selecting unit 524 may select a total-amount control mode of surface effect whose priority level is highest in the surface effect types in the page as the total-amount control mode of the page. Alternatively, the selecting unit 524 may select a total-amount control mode which is same as a total-amount control mode of a previous page or a next page so that the frequency of total-amount control mode switching is reduced.

Description goes back to that about the print control method with reference to FIG. 23. After selecting total-amount control modes for every page by performing the operation at Step S33, the selecting unit 524 selects total-amount control modes of the clear-toner image data on a per-predetermined-unit basis (on the per-page basis, the multiple-page basis, the per-sheet-containing-multiple-pages basis, or the per-print-job basis). The selecting unit 524 transmits information indicating the selected total-amount control modes to the obtaining unit 525.

The obtaining unit 525 obtains a total-amount limit value and an engine speed of each of the total-amount control modes from the total-amount-control mode information 506 (Step S34). The obtaining unit 525 transmits information indicating the total-amount limit values of the total-amount control modes selected on the per-predetermined-unit basis to the first correcting unit 512 and the second correcting unit 526. The obtaining unit 525 transmits information indicating the engine speeds of the total-amount control modes selected on the per-predetermined-unit basis to the transmitting unit 507.

The first correcting unit 512 receives the color-toner image data from the first generating unit 511 and receives the information indicating the total-amount limit values of the total-amount control modes selected on the per-predetermined-unit basis from the obtaining unit 525. The first correcting unit 512 corrects the color-toner image data based on the total-amount limit values (Step S35). The first correcting unit 512 transmits the corrected color-toner image data to the halftone engine 505.

The second correcting unit 526 receives the clear-toner image data from the second generating unit 521 and receives the information indicating the total-amount limit values of the total-amount control modes selected on the per-predetermined-unit basis from the obtaining unit 525. The second correcting unit 526 corrects the clear-toner image data based on the total-amount limit values (Step S36). The second correcting unit 526 transmits the corrected clear-toner image data to the halftone engine 505.

The halftone engine 505 receives the corrected color-toner image data from the first correcting unit 512 and the corrected clear-toner image data from the second correcting unit 526. The halftone engine 505 performs halftoning on the color-toner image data and the clear-toner image data (Step S37). The halftone engine 505 transmits the color-toner image data and the clear-toner image data having undergone the halftoning to the transmitting unit 507.

The transmitting unit 507 receives the color-toner image data and the clear-toner image data having undergone the halftoning from the halftone engine 505 and receives the information indicating the engine speeds of the total-amount control modes selected on the per-predetermined-unit basis from the obtaining unit 525. The transmitting unit 507 transmits the color-toner image data and the clear-toner image data having undergone the halftoning and the information indicating the engine speeds of the total-amount control modes selected on the per-predetermined-unit basis to the printer 70 via the MIC 60 (Step S38).

The printer 70 performs a printing process using the color-toner image data and the clear-toner image data having undergone the halftoning with the engine speeds of the total-amount control modes selected on the per-predetermined-unit basis (Step S39).

In the above described example, both the color-toner image data and the clear-toner image data are corrected (at Step S35 and Step S36, respectively). Alternatively, only the operation at either Step S35 or S36 may be performed. More specifically, only one of the color-toner image data and the clear-toner image data may be corrected based on the total-amount limit values.

As described above, the DFE 50 of the first embodiment stores the surface-effect choice information 522 which defines, on a per-density-value basis of the gloss-control-plane image data, types of surface effect to be applied using the clear toner, total-amount control modes, and priority levels according to which the total-amount control modes are to be applied. The selecting unit 524 selects total-amount control modes for use in printing clear-toner image data according to the priority levels. More specifically, the selecting unit 524 selects a total-amount control mode of surface effect whose priority level is highest in total-amount control modes of surface effect types associated with gloss control values contained in the gloss-control-plane image data. Accordingly, switching to an appropriate total-amount control mode can be made while taking influence of the total amount control on surface effect into account.

The selecting unit 524 may be configured to select a total-amount control mode for use in printing clear-toner image data in accordance with a total-amount control mode and a priority level specified by a user through input operations rather than selecting a total-amount control mode and a priority level based on the surface-effect choice information 522 stored in advance. The user's input operations may be accepted by either the host apparatus 10 or the DFE 50. A configuration which allows updating the surface-effect choice information 522 stored in advance in response to user's input operation may be employed.

Second Embodiment

The print control system 100 of a second embodiment is described below. The print control system 100 of the second embodiment implements a part of processing performed by the print control system 100 of the first embodiment by utilizing a cloud system.

Figure 26:
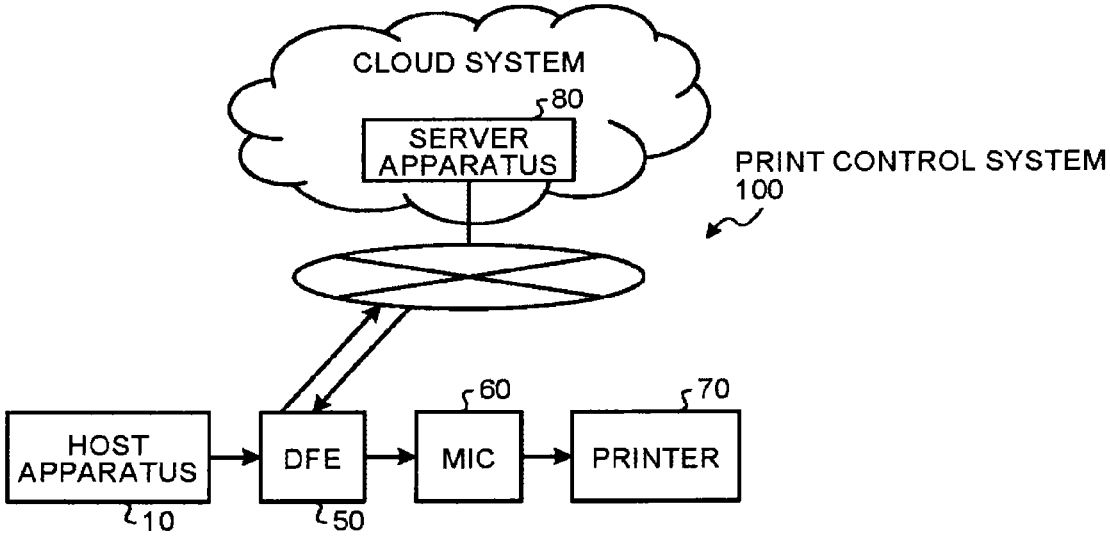
FIG. 26 is a diagram illustrating an example configuration of a print control system of a second embodiment.

FIG. 26 is a diagram illustrating an example configuration of the print control system 100 of the second embodiment. The print control system 100 of the second embodiment includes the host apparatus 10, the DFE 50, the MIC 60, the printer 70, and a server apparatus 80 on the cloud system. The server apparatus 80 on the cloud system includes some of the functional blocks of the DFE 50 of the first embodiment. The host apparatus 10, the MIC 60, and the printer 70 of the second embodiment are identical to those of the print control system 100 of the first embodiment, and repeated description is omitted.

Figure 27:
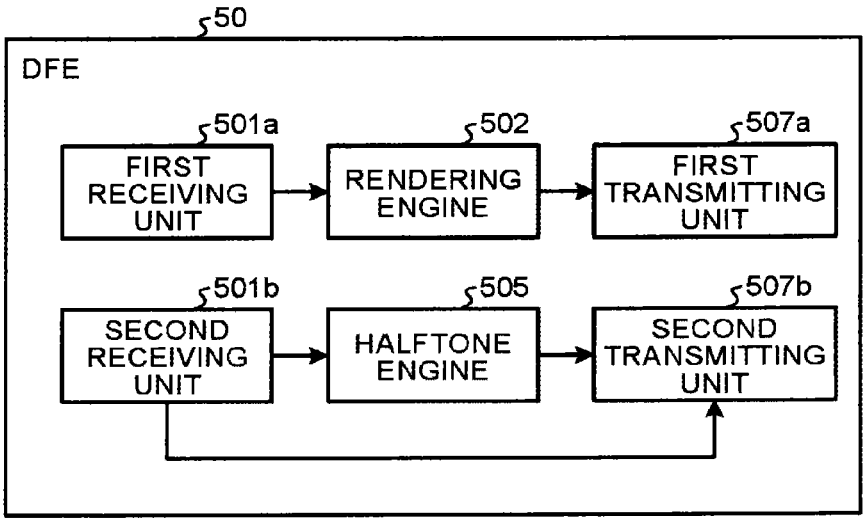
FIG. 27 is a diagram illustrating an example configuration of the DFE of the second embodiment.

FIG. 27 is a diagram illustrating an example configuration of the DFE 50 of the second embodiment. The DFE 50 of the second embodiment includes a first receiving unit 501*a*, a second receiving unit 501*b*, the rendering engine 502, the halftone engine 505, a first transmitting unit 507*a*, and a second transmitting unit 507*b*.

The first receiving unit 501*a* receives print data from the host apparatus 10. The print data contains at least color-plane image data and further contains, in a case where surface effect is to be applied to an image, gloss-control-plane image data. The first receiving unit 501*a* transmits the received print data to the rendering engine 502.

The rendering engine 502 interprets the print data (the color-plane image data and the gloss-control-plane image data) and converts the print data from a vector format into a raster format. The rendering engine 502 transmits the print data in the raster format to the first transmitting unit 507*a*.

The first transmitting unit 507*a* transmits the print data (the color-plane image data and the gloss-control-plane image data) in the raster format to the server apparatus 80.

The second receiving unit 501*b* receives color-toner image data, clear-toner image data, and information indicating engine speeds of total-amount control modes selected on a per-predetermined-unit basis from the server apparatus 80. The second receiving unit 501*b* transmits the color-toner image data and the clear-toner image data to the halftone engine 505. The second receiving unit 501*b* transmits the information indicating the engine speeds of the total-amount control modes selected on the per-predetermined-unit basis to the second transmitting unit 507*b*.

The halftone engine 505 performs halftoning on the color-toner image data and the clear-toner image data. The halftone engine 505 transmits the color-toner image data and the clear-toner image data having undergone the halftoning to the second transmitting unit 507*b*.

The second transmitting unit 507*b* receives the color-toner image data and the clear-toner image data having undergone the halftoning from the halftone engine 505 and receives the information indicating the engine speeds of the total-amount control modes selected on the per-predetermined-unit basis from the second receiving unit 501*b*. The second transmitting unit 507*b* transmits the color-toner image data and the clear-toner image data having undergone the halftoning and the information indicating the engine speeds of the total-amount control modes selected on the per-predetermined-unit basis to the printer 70 via the MIC 60.

Figure 28:
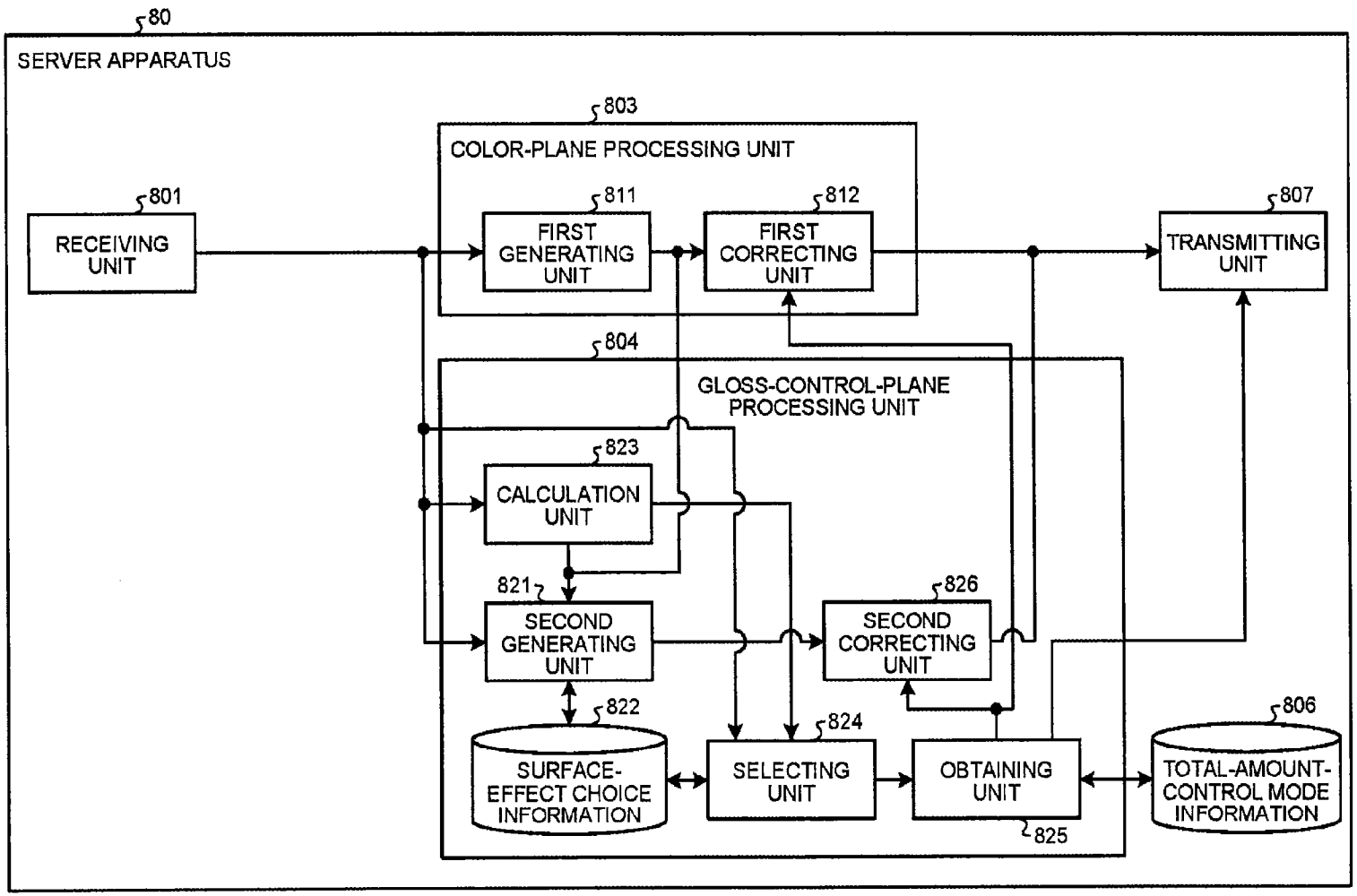
FIG. 28 is a diagram illustrating an example configuration of a server apparatus of the second embodiment.

FIG. 28 is a diagram illustrating an example configuration of the server apparatus 80 of the second embodiment. The server apparatus 80 of the second embodiment includes a receiving unit 801, a color-plane processing unit 803, a gloss-control-plane processing unit 804, total-amount-control mode information 806, and a transmitting unit 807. The color-plane processing unit 803 includes a first generating unit. 811 and a first correcting unit 812. The gloss-control-plane processing unit 804 includes a second generating unit 821, surface-effect choice information 822, a calculation unit 823, a selecting unit 824, an obtaining unit 825, and a second correcting unit 826. The server apparatus 80 stores the surface-effect choice information 822 and the total-amount-control mode information 806 in a storage unit (which is not shown in FIG. 28).

The server apparatus 80 of the second embodiment performs a part of processing performed by the DEE 50 of the first embodiment or, more specifically, the functional blocks of the DFE 50 except for the rendering engine 502 and the halftone engine 505. The receiving unit 801 receives the print data (the color-plane image data and the gloss-control-plane image data) in the raster format from the DEE 50. The receiving unit 801 transmits the color-plane image data to the color-plane processing unit 803. The receiving unit 801 transmits the gloss-control-plane image data to the gloss-control-plane processing unit 804. The color-plane processing unit 803, the gloss-control-plane processing unit 804, and the total-amount-control mode information 806 of the second embodiment are identical to those of the first embodiment, and repeated description is omitted. The transmitting unit 807 receives the color-toner image data from the color-plane processing unit 803, and receives the clear-toner image data and the information indicating the engine speeds of total-amount control modes selected on the per-predetermined-unit basis from the gloss-control-plane processing unit 804. The transmitting unit 807 transmits the color-toner image data, the clear-toner image data, and information indicating engine speeds of total-amount control modes selected on a per-predetermined-unit basis to the DFE 50.

Figure 29:
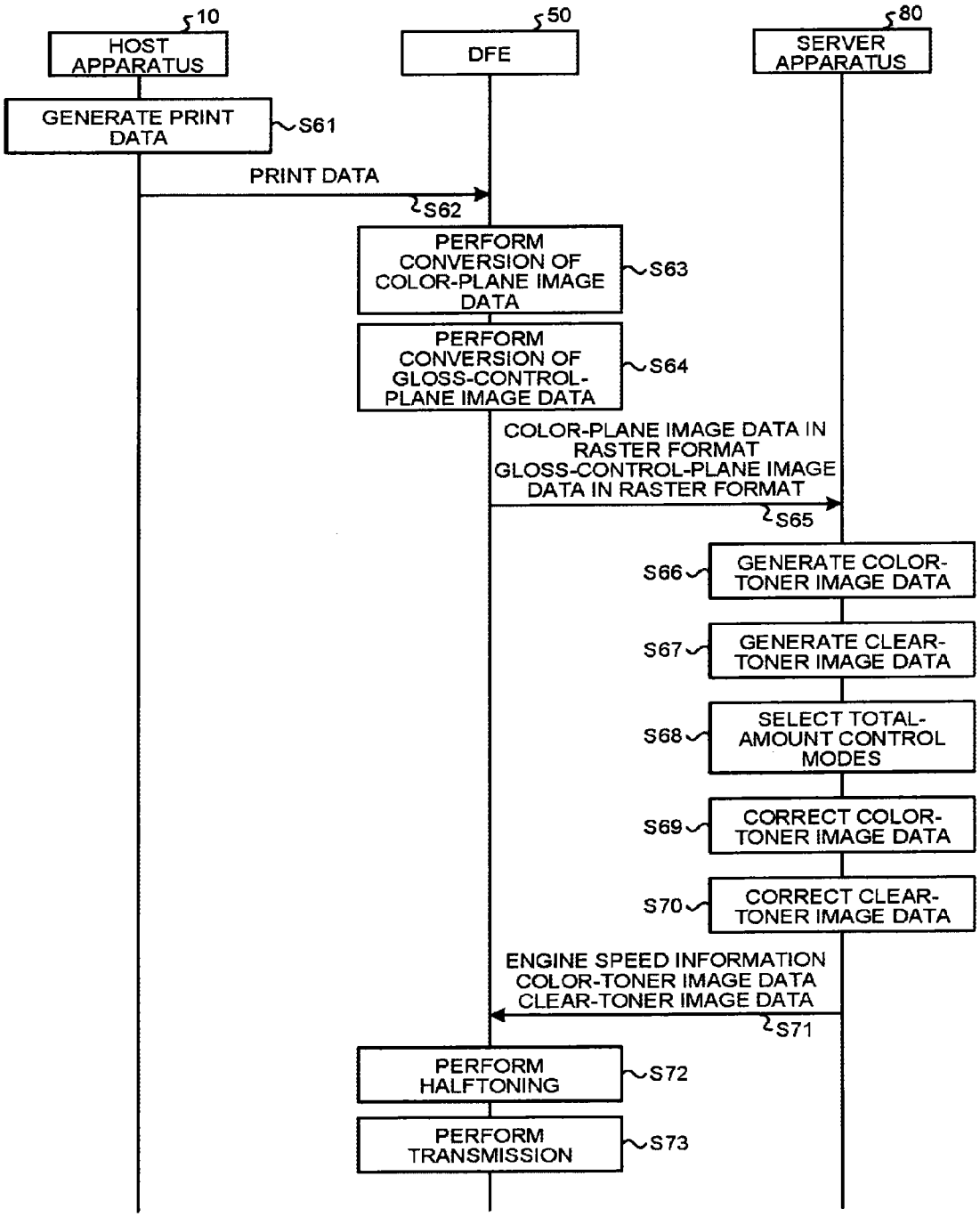
FIG. 29 is a sequence diagram illustrating an example of a print control method of the second embodiment.

FIG. 29 is a sequence diagram illustrating an example of a print control method of the second embodiment. Steps in the method are identical to corresponding steps of the first embodiment, and repeated description is omitted. The host apparatus 10 generates the print data described above (Step S61). The host apparatus 10 transmits the print data to the DFE 50 (Step S62).

The DFE 50 receives the print data (the color-plane image data and the gloss-control-plane image data) from the server apparatus 80. The DFE 50 converts the color-plane image data from the vector format into the raster format (Step S63). The DFE 50 converts the gloss-control-plane image data from the vector format into the raster format (Step S64). The DFE 50 transmits the color-plane image data in the raster format and the gloss-control-plane image data in the raster format to the server apparatus 80 (Step S65).

The server apparatus 80 generates color-toner image data from the color-plane image data in the raster format (Step S66). The server apparatus 80 generates clear-toner image data from the gloss-control-plane image data in the raster format (Step S67). The server apparatus 80 selects total-amount control modes (total-amount limit values and engine speeds) based on the gloss-control-plane image data in the raster format and the surface-effect choice information 822 (Step S68). The server apparatus 80 corrects the color-toner image data based on the total-amount limit values (Step S69). The server apparatus 80 corrects the clear-toner image data based on the total-amount limit values (Step S70). The server apparatus 80 transmits information indicating the engine speeds of the total-amount control modes selected on a per-predetermined-unit basis, the color-toner image data, and the clear-toner image data to the DFE 50 (Step S71).

The DFE 50 performs halftoning on the color-toner image data and the clear-toner image data (Step S72). The DFE 50 transmits the color-toner image data and the clear-toner image data having undergone the halftoning and the information indicating the engine speeds of the total-amount control modes selected on the per-predetermined-unit basis to the printer 70 via the MIC 60 (Step S73).

According to the print control system 100 of the second embodiment, the server apparatus 80 on the cloud system performs selection of total-amount control modes and the like. Accordingly, the server apparatus 80 can be shared among a plurality of the print control systems 100. Therefore, the print control system 100 of the second embodiment can attain reduction in operating cost and hardware cost by centralized management of the surface-effect choice information 822 and the like.

Processing to be performed by the server apparatus 80 on the cloud system is not limited to that of the second embodiment. The server apparatus 80 may be configured to perform any part of processing of the DFE 50. Alternatively, the server apparatus 80 on the cloud system may be configured to perform all processing of the DFE 50. Further alternatively, the server apparatus 80 on the cloud system may be configured to include multiple servers so that processing load on the server apparatus 80 can be distributed.

Figure 30:
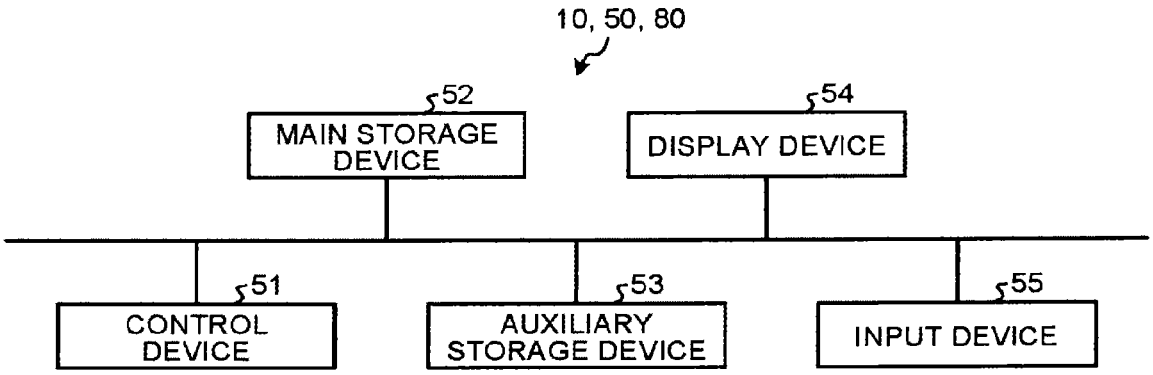
FIG. 30 is a diagram illustrating an example hardware structure of the host apparatus and the DFE of the first and second embodiments and the server apparatus of the second embodiment.

A hardware structure of the host apparatus 10 and the DFE 50 of the first and second embodiments and the server apparatus 80 of the second embodiment is described below. FIG. 30 is a diagram illustrating an example of the hardware structure of the host apparatus 10 and the DFE 50 of the first and second embodiments and the server apparatus 80 of the second embodiment.

Each of the host apparatus 10, the DFE 50, and the server apparatus 80 has hardware structure of a typical computer. More specifically, each of the host apparatus 10, the DFE 50, and the server apparatus 80 includes a control device 51, a main storage device 52, an auxiliary storage device 53, a display device 54, and an input device 55. The control device 51 which provides overall control of the apparatus may be embodied as a CPU or the like. The main storage device 52 which stores various types of data and programs may be embodied as a ROM, a RAM, or the like. The auxiliary storage device 53 which stores various types of data and programs may be embodied as an HDD or the like. The display device 54 may be embodied as a display device or the like. The input device 55 may be embodied as a keyboard, a mouse, and/or the like.

An image processing program (including the image processing application (the same applies to the following)) to be executed by the host apparatus 10 of the first or second embodiment may be provided as a computer program product recorded on a non-transitory computer-readable recording medium, such as a compact disc-ROM (CD-ROM), a flexible disk (FD), a CD-recordable (CD-R), or a digital versatile disk (DVD), as a file in a computer-installable or computer-executable format.

The image processing program to be executed by the host apparatus 10 of the first or second embodiment may be stored on a computer connected to a network such as the Internet and configured to be downloaded via the network. The image processing program to be executed by the host apparatus 10 of the first or second embodiment may be configured to be provided or distributed via a network such as the Internet.

The image processing program to be executed by the host apparatus 10 of the first or second embodiment may be configured to be provided as being preinstalled on a ROM or the like.

The image processing program to be executed by the host apparatus 10 of the first or second embodiment has a module structure including the above-described units (the image processing unit, the plane-data generating unit, the print-data generating unit, the input control unit, and the display control unit). From the viewpoint of actual hardware, the CPU (processor) reads out the image processing program from the storage medium and executes the program to load the units on the main storage device, thereby generating the input control unit 211, the image processing unit 212, the display control unit 213, the plane-data generating unit 214, and the print-data generating unit 215 on the main storage device.

The print control process to be performed by the DFE 50 or the server apparatus 80 of the first or second embodiment may be implemented in hardware. Alternatively, the print control process may be implemented in software as a print control program. In this case, the print control program to be executed by the DFE 50 or the server apparatus 80 of the first or second embodiment may be provided as being preinstalled on a ROM or the like.

The print control program to be executed by the DFE 50 or the server apparatus 80 of the first or second embodiment may be configured to be provided as a computer program product recorded on a non-transitory computer-readable recording medium, such as a CD-ROM), an FD, a CD-R, or a DVD, as a file in a computer-installable or computer-executable format.

The print control program to be executed by the DFE 50 or the server apparatus 80 of the first or second embodiment may be stored on a computer connected to a network such as the Internet and configured to be downloaded via the network. The print control program to be executed by the DFE 50 or the server apparatus 80 of the first or second embodiment may be configured to be provided or distributed via a network such as the Internet.

The print control program to be executed by the DFE 50 or the server apparatus 80 of the first or second embodiment has a module structure including the above-described units (the receiving unit 501 (801), the rendering engine 502, the color-plane processing unit 503 (803), the gloss-control-plane processing unit 504 (804), the halftone engine 505, and the transmitting unit 507 (807)). From the viewpoint of actual hardware, the CPU (processor) reads out the print control program from the ROM and executes the program to load the units on the main storage device, thereby generating the receiving unit 501, the rendering engine 502, the color-plane processing unit 503, the gloss-control-plane processing unit 504, the halftone engine 505, and the transmitting unit 507 on the main storage device.

In each of the image forming systems according to the first and second embodiments, images are formed using toners of multiple colors or, more specifically, the CMYK toners. Alternatively, the image forming system may be configured to form images using a toner of a single color.

In each of the image forming systems according to the first and second embodiments, the selecting unit 524 selects total-amount control modes based on priority levels and area ratios. Alternatively, the image forming system may be configured to select total-amount control modes based on either the priority levels or the area ratios.

In each of the image forming systems according to the first and second embodiments, the calculation unit 523 calculates ((the area of the same-density-value region)/(the area of the entire image)) for each of the same-density-value regions. Alternatively, a configuration in which the calculation unit 523 calculates areas of the same-density-value regions, and the selecting units 524 selects total-amount control modes using the areas may be employed.

According to an aspect of the present invention, switching to an appropriate total-amount control mode can be made while taking influence of total amount control on surface effect into account.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A print control apparatus, comprising:

a receiving circuit that receives gloss-control-plane image data indicating gloss control values, each of the gloss control values identifying types of surface effects to be applied using a transparent developing material to a region on a recording member where an image is to be recorded and the region where the surface effect is to be applied on the recording member;

a storage circuit that stores surface-effect choice information defining, for each of the types of surface effects, total-amount-control mode information including multiple total-amount control modes, each of the total-amount control modes being a combination of a total-amount limit value indicating an upper limit of a developing-material recording amount and a printing speed, types of a transparent-developing-material image data for providing the transparent developing material to the recording member, and a priority level of application of the corresponding total-amount control mode;

a generating circuit that generates the transparent-developing-material image data based on the gloss-control-plane image data and the surface-effect choice information;

a calculation circuit that calculates an area of a region to which the surface effect is to be applied for each of the types of surface effects by referring to the gloss-control-plane image data; and a selecting circuit that determines, in ascending order of priority level, whether the area of the region to which the surface effect is to be applied on the recording member is equal to or higher than a predetermined threshold, and selects a total-amount control mode, where the area of the region is equal to or higher than the predetermined threshold, for use in printing the transparent-developing-material image data from the total-amount control mode, based on the gloss-control-plane image data and the surface-effect choice information.

2. The print control apparatus according to claim 1, wherein the selecting circuit selects the total-amount control mode for use in printing the transparent-developing-material image data on any one of a per-page basis, a multiple-page basis, a per-sheet-containing-multiple-pages basis, and a per-print-job basis.

3. The print control apparatus according to claim 1, wherein the surface-effect choice information is varied by a type of the recording member for use in the printing.

4. The print control apparatus according to claim 1, further comprising:

an input circuit that receives an input specifying at least any one of the total-amount control mode, the priority level, and a unit based on which the total-amount control mode is to be selected, wherein the selecting circuit selects the total-amount control mode for use in printing the transparent-developing-material image data in accordance with the input.

5. The print control apparatus according to claim 1, wherein the selecting circuit selects the total-amount control mode of which priority level is highest in the total-amount control mode of surface effect types associated with the gloss control values included in the gloss-control-plane image data.

6. A print control method performed by a print control apparatus, the print control method comprising:

receiving gloss-control-plane image data indicating gloss control values, each of the gloss control values identifying types of surface effects to be applied using a transparent developing material to a region on a recording member where an image is to be recorded and the region where the surface effect is to be applied on the recording member;

storing, by a storage circuit, surface-effect choice information defining, for each of the types of surface effects:

total-amount-control mode information including multiple total-amount control modes, each of the total-amount control modes being a combination of a total-amount limit value indicating an upper limit of a developing-material recording amount and a printing speed, types of a transparent-developing-material image data for providing the transparent developing material to the recording member, and a priority level of application of the corresponding total-amount control mode;

generating, by a generating circuit, the transparent-developing-material image data based on the gloss-control-plane image data and the surface-effect choice information;

calculating, by a calculation circuit, an area of a region to which the surface effect is to be applied for each of the types of surface effects by referring to the gloss-control-plane image data;

determining, by a selecting circuit in ascending order of priority level, whether the area of the region to which the surface effect is to be applied on the recording member is equal to or higher than a predetermined threshold; and selecting, by the selecting circuit, a total-amount control mode, where the area of the region is equal to or higher than the predetermined threshold, for use in printing the transparent-developing-material image data from the total-amount control mode, based on the gloss-control-plane image data and the surface-effect choice information.

7. The print control method according to claim 6, wherein the selecting includes selecting the total-amount control mode for use in printing the transparent-developing-material image data on any one of a per-page basis, a multiple-page basis, a per-sheet-containing-multiple-pages basis, and a per-print-job basis.

8. The print control method according to claim 6, wherein the surface-effect choice information is varied by a type of the recording member for use in the printing.

9. The print control method according to claim 6, further comprising:

receiving an input specifying at least any one of the total-amount control mode, the priority level, and a unit based on which the total-amount control mode is to be selected, wherein the selecting includes selecting the total-amount control mode for use in printing the transparent-developing-material image data in accordance with the input.

10. A non-transitory computer-readable medium comprising computer readable program instructions that, when performed by a computer, cause the computer to:

receive gloss-control-plane image data indicating gloss control values, each of the gloss control values identifying types of surface effects to be applied using a transparent developing material to a region on a recording member where an image is to be recorded and the region where the surface effect is to be applied on the recording member;

store surface-effect choice information defining, for each of the types of surface effects:

total-amount-control mode information including multiple total-amount control modes, each of the total-amount control modes being a combination of a total-amount limit value indicating an upper limit of a developing-material recording amount and a printing speed, types of a transparent-developing-material image data for providing the transparent developing material to the recording member, and a priority level of application of the corresponding total-amount control mode;

generate the transparent-developing-material image data based on the gloss-control-plane image data and the surface-effect choice information;

calculate an area of a region to which the surface effect is to be applied for each of the types of surface effects by referring to the gloss-control-plane image data;

determine, in ascending order of priority level, whether the area of the region to which the surface effect is to be applied on the recording member is equal to or higher than a predetermined threshold; and select a total-amount control mode, where the area of the region is equal to or higher than the predetermined threshold, for use in printing the transparent-developing-material image data from the total-amount control mode, based on the gloss-control-plane image data and the surface-effect choice information.

11. The non-transitory computer-readable medium according to claim 10, wherein the computer is caused to select the total-amount control mode for use in printing the transparent-developing-material image data on any one of a per-page basis, a multiple-page basis, a per-sheet-containing-multiple-pages basis, and a per-print-job basis.

12. The non-transitory computer-readable medium according to claim 10, wherein the surface-effect choice information is varied by a type of the recording member for use in the printing.

13. The non-transitory computer-readable medium according to claim 10, wherein the computer is further caused to:

receive an input specifying at least any one of the total-amount control mode, the priority level, and a unit based on which the total-amount control mode is to be selected; and select the total-amount control mode for use in printing the transparent-developing-material image data in accordance with the input.

* * * * *